US010029868B2

(12) United States Patent
Mori

(10) Patent No.: US 10,029,868 B2
(45) Date of Patent: Jul. 24, 2018

(54) SHEET FEED DEVICE AND IMAGE FORMING APPARATUS INCLUDING THE SAME

(71) Applicant: Sharp Kabushiki Kaisha, Osaka (JP)

(72) Inventor: Kouji Mori, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/415,249

(22) Filed: Jan. 25, 2017

(65) Prior Publication Data

US 2017/0210577 A1 Jul. 27, 2017

(30) Foreign Application Priority Data

Jan. 27, 2016 (JP) ..... 2016-013245

(51) Int. Cl.
*B65H 3/06* (2006.01)
*B65H 1/14* (2006.01)
*B65H 3/56* (2006.01)

(52) U.S. Cl.
CPC ..... *B65H 3/0684* (2013.01); *B65H 1/14* (2013.01); *B65H 3/565* (2013.01); *B65H 2404/144* (2013.01); *B65H 2801/06* (2013.01)

(58) Field of Classification Search
CPC ..... B65H 3/06; B65H 3/0669; B65H 3/0684; B65H 3/34; B65H 3/46; B65H 3/56; B65H 3/565; B65H 7/18; B65H 7/20
See application file for complete search history.

(56) References Cited

U.S. PATENT DOCUMENTS

2007/0262511 A1* 11/2007 Ohshima ..... B65H 3/56 271/10.01
2008/0002010 A1* 1/2008 Nakashima ..... B41J 13/103 347/104

FOREIGN PATENT DOCUMENTS

JP 06-001492 1/1994

* cited by examiner

*Primary Examiner* — David H Bollinger
(74) *Attorney, Agent, or Firm* — Renner Otto Boisselle & Sklar, LLP

(57) ABSTRACT

A sheet feed device includes a stacking tray on which sheets P are stacked, and feed rollers convey the sheets P from the stacking tray. The sheet feed device also includes a pressing lever configured to press back, when there is a sheet picked up from the stacking tray and is in a state of being nipped between feed rollers, a leading end of the sheet P toward the stacking tray, and a roller separating mechanism configured to separate the sheet feed rollers performing the nipping from each other, when the pressing member performs the operation of pressing back the sheet.

11 Claims, 18 Drawing Sheets

SHEET FEED DEVICE AND IMAGE FORMING APPARATUS INCLUDING THE SAME

CROSS-REFERENCE TO RELATED APPLICATIONS

The present application claims the benefit of priority to Japanese Patent Application No. 2016-013245, the entirety of which is incorporated herein by reference, filed on Jan. 27, 2016 under Section 119(a) of 35 U.S.C.

BACKGROUND ART

Field of the Invention

The present invention relates to a sheet feed device that feeds a sheet, such as a recording sheet, in a predetermined sheet feed direction, and an image forming apparatus, such as a copier, a multifunction peripheral, a printer, or a FAX machine, including the same.

Description of the Related Art

One conventionally known sheet feed device (what is known as a sheet feeder) that feeds a sheet, such as a recording sheet, in a predetermined sheet feed direction includes: a stacking tray on which sheets, such as recording sheets, are stacked in a liftable manner; and an openable cover that can be opened and closed to cover the stacking tray.

For example, when the sheet feed device no longer includes the sheets on the stacking tray, a user performs a sheet supplying operation for supplying the sheets, with the openable cover open. When the sheets are supplied, the stacking tray is lowered so that a sheet supplied space is ensured on the stacking tray.

When the user opens the openable cover for supplying the sheets while a sheet feeding operation by the sheet feed device is in process, emergency stop of sheet conveyance is activated with the sheet nipped between a pair of feed rollers. When the stacking tray starts lowering for the sheet supplying, the sheet remains nipped by the feed roller and hinders the sheet supplying operation on the stacking tray.

When paper jam occurs in the image forming apparatus while the sheet is being conveyed, the apparatus might stop with the sheet being nipped by conveyance rollers. Various techniques have been proposed to make the removal of the sheet nipped between the rollers easy for the user. Japanese Unexamined Patent Application Publication No. H6-1492 discloses a configuration in which when a sheet fed from a manual feed tray is jammed at a registration rollers, the sheet can be pulled out from a manual feed tray side with the nipping between the registration rollers released.

SUMMARY OF THE INVENTION

The configuration disclosed in Japanese Unexamined Patent Application Publication No. H6-1492 may be applied to the feed rollers of the sheet feed device. In such a case, when the sheet conveyance stops with the sheet being nipped by the feed rollers, the sheet can be pulled out from a stacking tray side with the nipping by the feed rollers released. Even with such a configuration, the user still has to remove the sheet, and the sheet supplying for the sheet feed device is cumbersome. The user trying to remove the sheet might accidentally touch and thus might damage a sheet feed member.

As described above, the user might open the openable cover of the sheet feed device while the sheet feed operation is in process, and thus the sheet conveyance might stop with the sheet being nipped by the feed rollers. Technically, this is not a paper jam but might be regarded as such by the user because the conveyance has stopped while the sheet is being nipped by the pair of feed rollers.

The present invention is made in view of the problem described above, and an object of the present invention is to provide a sheet feed device with which conveyance can be prevented from stopping in a state where a sheet is nipped between feed rollers, when a user opens an openable cover of the sheet feed device or the other like incident occurs.

To solve the problem described above, a sheet feed device according to one aspect of the present invention includes a stacking tray on which sheets are stacked, a pair of sheet feed rollers configured to convey the sheets from the stacking tray, and a pressing member configured to perform operation for pressing back a sheet that has been picked up from the stacking tray and is in a state of being nipped between the sheet feed rollers toward the stacking tray, at a predetermined timing.

For example, sheet conveyance might stop with a sheet being nipped between the sheet feed rollers at a timing at which a user opens the openable cover of the sheet feed device while a sheet feeding operation is in process. In the configuration described above, the pressing member presses a leading end of the sheet back toward the stacking tray at such a predetermined timing. Thus, the sheet is prevented from remaining in the state of being nipped by the sheet feed rollers, and does not hinder a sheet supply operation on the stacking tray.

In the sheet feed device, the pressing member may be configured to perform the operation of pressing back the sheet, at at least one of a timing at which a print job is terminated and a timing at which opening of an openable cover of the sheet feed device is detected.

In the configuration described above, the sheet pressing operation can be performed at a timing at which the sheet might be remaining in the state of being nipped between the sheet feed rollers.

In the sheet feed device, the pressing member may be configured to perform the operation of pressing back the sheet, at least one of a timing at which a first sheet detection sensor, disposed immediately on a downstream side of the sheet feed roller, detects that the sheet is present for a predetermined time period, and a timing at which a second sheet detection sensor, disposed before a nip portion between the sheet feed rollers, detects that the sheet is present for a predetermined time period.

In the configuration described above, whether the sheet is remaining in the state of being nipped by the sheet feed rollers is detected, and the sheet pressing operation can be performed at a timing at which such a state of the sheet P is detected.

In the sheet feed device, the pressing member may include a lever portion capable of pivoting about a fulcrum, and the lever portion may be configured to move from a downstream side to an upstream side, over a nip portion between the sheet feed rollers, in a conveyance direction on a conveyance path for the sheet when the pressing member performs the operation of pressing back the sheet.

In the configuration described above, the lever portion of the pressing member moves from downstream side to the upstream side, over the nip portion between the sheet feed rollers, in the conveyance direction on the conveyance path for the sheet. Thus, the sheet in the state of remaining nipped by the sheet feed rollers can be certainly pressed back to the stacking tray.

The sheet feed device may further include a holding member configured to hold the pressing member, the sheet feed rollers may be disposed more on a downstream side in a conveyance direction than the holding member, and the holding member may be configured to be detachably attached to a main body of the sheet feed device.

In the configuration described above, the pressing member can be removed from the sheet feed device together with the holding member. Thus, a maintenance (such as repairing) can be easily performed on the sheet feed rollers disposed more on the downstream side than the holding member in the conveyance direction.

The sheet feed device may further include a first lever that is provided to the main body of the sheet feed device and is driven by a driving unit, the pressing member may be engaged with the first lever, and may be configured to receive driving force from the first lever.

In the configuration described above, the pressing member is operated with the driving force transmitted from the driving unit due to the engagement between the first lever and the pressing member. Thus, the driving force can be easily transmitted to the pressing member detachably attached to the sheet feed device.

The sheet feed device may further include a roller separating mechanism configured to separate the sheet feed rollers performing the nipping from each other, when the pressing member performs the operation of pressing back the sheet.

In the configuration described above, the sheet feed rollers performing the nipping are separated from each other by the roller separating mechanism so that the pressing member can certainly perform the sheet pressing operation.

In the sheet feed device, the pressing member and the roller separating mechanism may be driven by a same driving unit.

In the configuration described above, the pressing member and the roller separating mechanism share the driving unit. Thus, the sheet feed device can have a simplified configuration.

In the sheet feed device, the pressing member may perform the operation of pressing back the sheet after the roller separating mechanism has performed the operation of separating the sheet feed rollers performing the nipping from each other.

In the configuration described above, the sheet pressing operation can be certainly performed without being hindered by the sheet nipping by the sheet feed rollers.

In the sheet feed device, the holding member may include a guide member configured to guide the sheets on the stacking tray to the sheet feed rollers.

In the configuration described above, the holding member includes the guide unit, and thus can have a large size in a sheet width direction. The maintenance on the sheet feed roller can be even more easily performed with the holding member with a large size removed.

DESCRIPTION OF THE EMBODIMENTS

An embodiment of the present invention is described below with reference to the drawings.

(Overall Configuration of Image Forming Apparatus)

Figure 1:
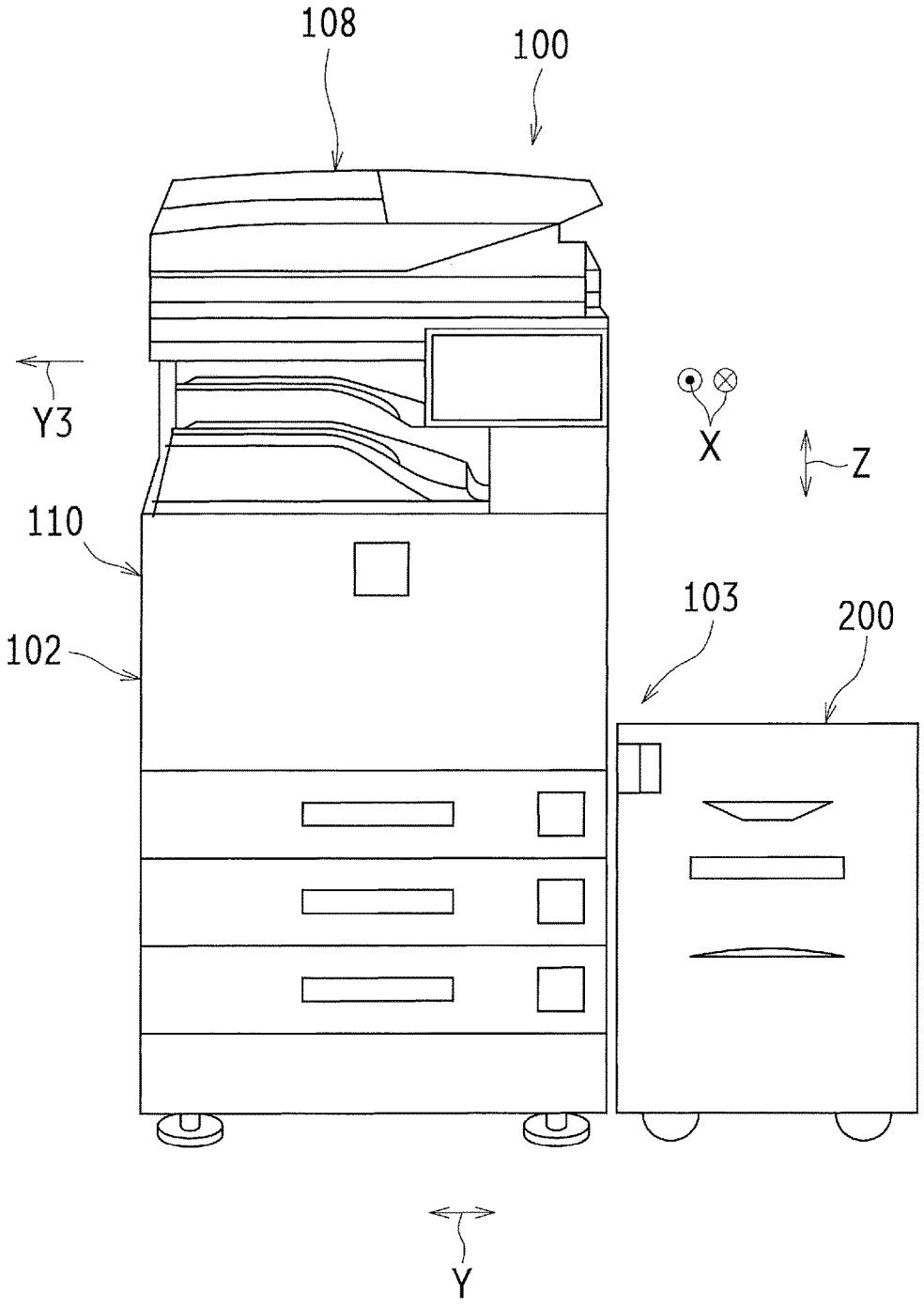
FIG. 1 is a schematic front view of an image forming apparatus including a sheet feed device according to an embodiment.
Figure 2:
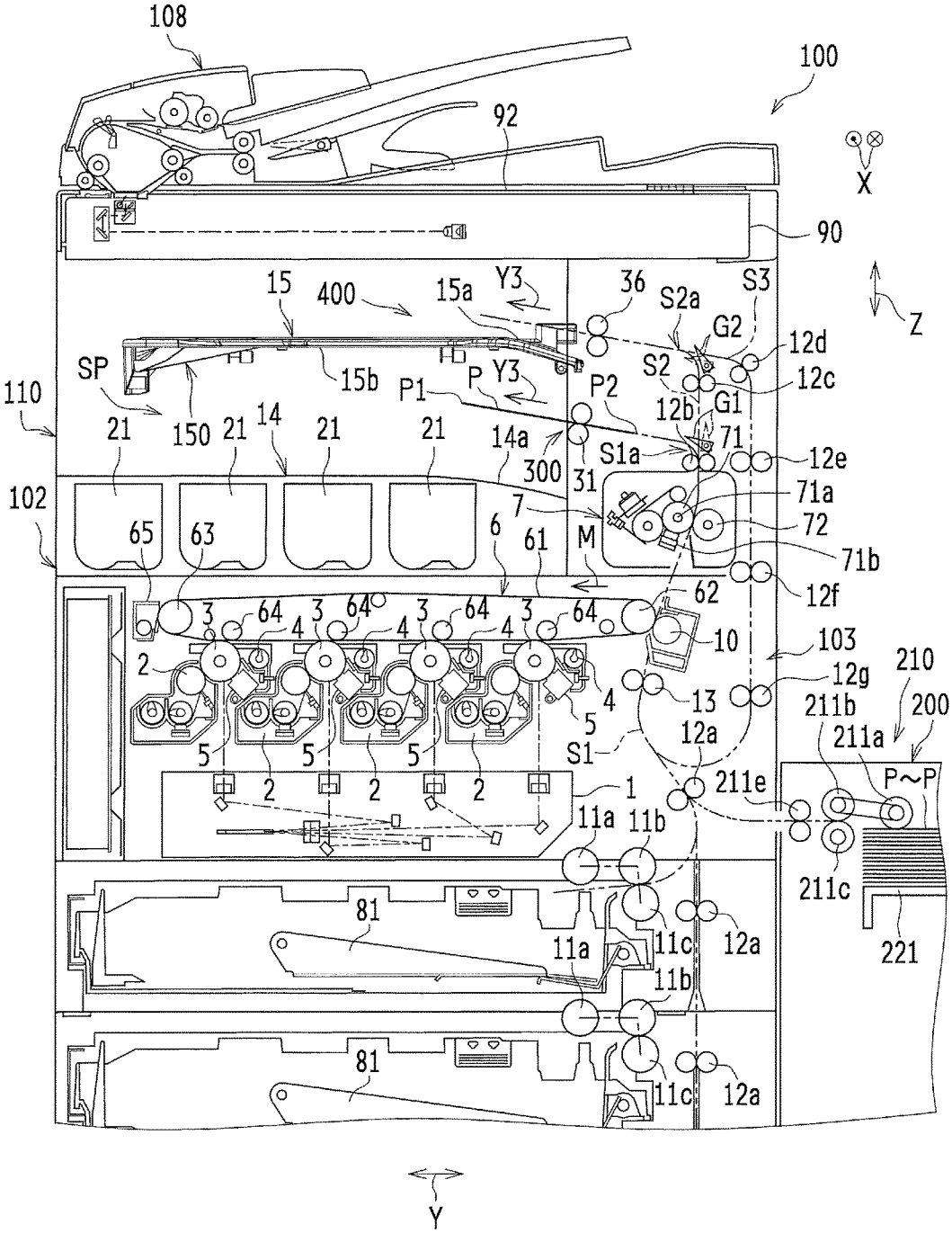
FIG. 2 is a schematic cross-sectional front view of the image forming apparatus according to the present embodiment.

FIG. 1 is a schematic front view of an image forming apparatus 100 including a sheet feed device 200 according to the present embodiment. FIG. 2 is a schematic cross-sectional front view of the image forming apparatus 100 according to the present embodiment.

The image forming apparatus 100 illustrated in FIG. 1 and FIG. 2 is a color image forming apparatus that forms a multicolor or monochrome image on a sheet P (see FIG. 2) such as a recording sheet, in accordance with image data transmitted thereto from the outside. The image forming apparatus 100 includes: a document read apparatus 108; an image forming apparatus main body 110; and the sheet feed device 200 (what is known as a sheet feeder, which is a large capacity sheet feeder in this example) (see FIG. 1). The image forming apparatus main body 110 includes an image forming unit 102 and a sheet conveyance system 103. More specifically, the image forming apparatus 100 is a multi-function peripheral having a copy function, a printer function, and a facsimile function.

As illustrated in FIG. 2, the image forming unit 102 includes an exposing unit 1, a plurality of development units 2 to 2, a plurality of photosensitive drums 3 to 3, a plurality of cleaning units 4 to 4, a plurality of charging units 5 to 5, an intermediate transfer belt unit 6, a plurality of toner cartridge units 21 to 21, and a fixing unit 7.

The sheet conveyance system 103 includes a paper feed tray 81, the sheet feed device 200, a discharge tray 14, and a sheet discharge device 400.

The sheet discharge device 400 includes a sheet sorting unit 300 and an upper discharge tray 15. The sheet sorting unit 300 sorts the sheet P, discharged by discharge rollers 31, by shifting the discharge rollers 31 in an axial direction (shift direction) (depth direction X) of the discharge rollers 31. The discharge rollers 31 convey the sheet P in a predetermined conveyance direction Y3, so that the sheet P is discharged onto the discharge tray 14. The upper discharge tray 15 is disposed above the discharge tray 14 with a space SP in between. The discharge tray 14 may be a component of the sheet discharge device 400.

A platen 92 made of a transparent glass piece, on which a document (not illustrated) is placed, is provided in an upper portion of the image forming apparatus main body 110. An optical unit 90 that reads the document is disposed below the platen 92. The document read apparatus 108 is disposed on an upper side of the platen 92. The document read apparatus 108 automatically conveys the document onto the platen 92. The document read apparatus 108 is rotatably attached to the image forming apparatus main body 110. Thus, a front side can be opened to open a space on the platen 92 to enable manual placement of the document.

The document read apparatus 108 can read a document automatically conveyed thereto, and a document placed on the platen 92. An image of the document read by the document read apparatus 108 is transmitted as image data to the image forming apparatus main body 110 of the image forming apparatus 100. In the image forming apparatus main body 110, an image formed based on the image data is recorded on the sheet P.

The image data used in the image forming apparatus 100 corresponds to a color image using a plurality of colors (in this example, colors black (K), cyan (C), magenta (M), and yellow (Y)). Thus, a plurality of sets (in this example, four sets corresponding to black, cyan, magenta, and yellow) of the development units 2 to 2, the photosensitive drums 3 to 3, the cleaning units 4 to 4, the charging units 5 to 5, and the toner cartridge units 21 to 21 are provided to form a plurality of types of (in this example, four types) images corresponding to the colors. Thus, a plurality of (in this example, four) image stations are provided.

The charging units 5 to 5 uniformly charge surfaces of the photosensitive drums 3 to 3 to achieve a predetermined potential. The exposing unit 1 exposes each of the charged photosensitive drums 3 to 3 in accordance with the image data input, so that electrostatic latent images corresponding to the image data are formed on the surfaces of the photosensitive drums 3 to 3. The toner cartridge units 21 to 21 contain toner to be supplied to developer tanks of the development units 2 to 2. The development units 2 to 2 develop the electrostatic latent image formed on the photosensitive drums 3 to 3 with the toner of four colors (Y, M, C, and K). The cleaning units 4 to 4 remove and collect the toner remaining on the surfaces of the photosensitive drums 3 to 3, after the developing and image transferring.

The intermediate transfer belt unit 6 disposed above the photosensitive drums 3 to 3 includes: an intermediate transfer belt 61 serving as an intermediate transfer member; an intermediate transfer belt driving roller 62; an intermediate transfer belt driven roller 63; a plurality of intermediate transfer rollers 64 to 64; and an intermediate transfer belt cleaning unit 65.

Four intermediate transfer rollers 64 to 64 corresponding to the colors Y, M, C, and K are provided. The intermediate transfer belt 61 is spanned by the intermediate transfer belt driving roller 62, the intermediate transfer belt driven roller 63, and the intermediate transfer rollers 64 to 64. When the intermediate transfer belt driving roller 62 is drivingly rotated, the intermediate transfer belt 61 is rotationally moved in a movement direction M, and the intermediate transfer belt driven roller 63 and the intermediate transfer rollers 64 to 64 are driven to be rotated. Transfer bias, for transferring the toner images, formed on the photosensitive drums 3 to 3, onto the intermediate transfer belt 61, is applied to the intermediate transfer rollers 64 to 64. The intermediate transfer belt 61 is provided to be in contact with the photosensitive drums 3 to 3. The toner images of the corresponding colors formed on the photosensitive drums 3 to 3 are transferred onto a surface of the intermediate transfer belt 61 in an overlapping manner. Thus, a color toner image (multicolor toner image) is formed on the surface. The toner image on the intermediate transfer belt 61 is transferred onto the sheet P by a transfer roller 10. The toner remaining on the intermediate transfer belt 61 without being transferred onto the sheet P is removed and collected by the intermediate transfer belt cleaning unit 65.

One or a plurality of stages (three stages in this example) of the paper feed trays 81 are disposed below the exposing unit 1 in the image forming apparatus main body 110, and each accommodate the sheet P on which the image is to be formed (printed) through the process described above. In the sheet feed device 200, the sheets P on which the image is to be formed (printed) are accommodated while being stacked on a stacking tray 221. In this example, the sheet feed device 200 is a large capacity sheet feeder that accommodates a large amount of (for example at least 1000 sheets) sheets P. For example, the large capacity sheet feeder is referred to as a large capacity sheet feed cassette or a large capacity paper feed tray. The sheet feed device 200 is described in detail later.

The discharge tray 14 is disposed above the image forming unit 102 in the image forming apparatus main body 110. The sheets P on which the image has been formed (printed) are stacked face down on the discharge tray 14. The discharge tray 14 has a configuration in which an upstream side of a placement surface 14*a*, on which the sheet P is placed, is positioned lower than a downstream side in the conveyance direction Y3 of the sheet P. The discharge tray 14 is not limited to this. In this example, a sheet P for copying on which an image has been formed (printed) with the copy function, and a sheet P for printing on which an image has been formed (printed) with the printer function are discharged onto the discharge tray 14. The sheet P for copying and the sheet P for printing are sorted by the sheet sorting unit 300 and then are discharged onto the discharge tray 14.

The upper discharge tray 15 is disposed above the discharge tray 14 with the space SP in between, in the image forming unit 102 of the image forming apparatus main body 110. The sheets P on which the image has been formed (printed) are stacked face down on the upper discharge tray 15. The upper discharge tray 15 has a configuration similar to that of the discharge tray 14. More specifically, a placement surface 15*a*, on which the sheet P is placed, has an upstream side positioned lower than a downstream side in the conveyance direction Y3 of the sheet P. In this example, the sheet P for facsimile on which an image has been formed (printed) with the facsimile function is discharged onto the upper discharge tray 15. However, this should not be construed in a limiting sense.

The image forming apparatus main body 110 is provided with a sheet conveyance path S1 and an upper sheet conveyance path S2. In the sheet conveyance path S1, the sheet P transmitted from the paper feed trays 81 to 81 or the sheet feed device 200 is guided to the discharge tray 14 via the transfer roller 10 and the fixing unit 7. The upper sheet conveyance path S2, through which the sheet P is guided to the upper discharge tray 15, is branched upward from a branching portion S1*a* at a position between the fixing unit 7 and the discharge roller 31 of the sheet conveyance path S1. Pickup rollers 11*a* to 11*a* and 211*a*, a pair of feed rollers (11*b*, 11*c*) to (11*b*, 11*c*) and (211*b*, 211*c*), a plurality of conveyance rollers 12*a* to 12*a* and 12*b*, a registration roller 13, the transfer roller 10, a heat roller 71 and a pressure roller 72 in the fixing unit 7, and the discharge roller 31 are disposed near the sheet conveyance path S1.

An upper conveyance roller 12*c* and an upper discharge roller 36 are disposed near the upper sheet conveyance path S2. A branching claw G1 is disposed near the branching portion S1*a*. The branching claw G1 takes a first switch posture (a posture illustrated with a solid line in FIG. 2) with which the sheet P from the fixing unit 7 is guided to the discharge roller 31, and a second switch posture (a posture illustrated with a dotted line in FIG. 2) with which the sheet P from the fixing unit 7 is guided to the upper sheet conveyance path S2.

The upper discharge roller 36 rotates in a normal direction for discharging the sheet P onto the upper discharge tray 15 and rotates in a reverse direction for conveying the sheet P toward the opposite side of the conveyance direction Y3 (what is known as switchback). The image forming apparatus main body 110 is provided with a reversing sheet conveyance path S3 in which the sheet P from an upper branching portion S2*a* at an intermediate portion of the upper sheet conveyance path S2 is guided toward an upstream side of the registration roller 13 on the sheet conveyance path S1 while being reversed.

A plurality of (four in this example) reversing conveyance rollers 12*d* to 12*g* are disposed near the reversing sheet conveyance path S3. An upper branching claw G2 is disposed near the upper branching portion S2*a*. The upper branching claw G2 takes a first switch posture (a posture illustrated with a solid line in FIG. 2) with which the sheet P from the branching portion S1*a* is guided to the upper discharge roller 36, and a second switch posture (a posture illustrated with a dotted line in FIG. 2) with which the sheet P switched back from the upper discharge roller 36 is guided to the reversing sheet conveyance path S3.

The conveyance rollers 12*a* to 12*a*, and 12*b*, disposed along the sheet conveyance path S1, the upper conveyance roller 12*c*, disposed along the upper sheet conveyance path S2, and the reversing conveyance rollers 12*d* to 12*g*, disposed along the reversing sheet conveyance path S3, are small rollers facilitating and supporting the conveyance of the sheet P.

The pickup rollers 11*a* to 11*a* for the paper feed tray 81 are disposed near a sheet feed side of the paper feed trays 81 to 81, pick up the sheets P one by one from the paper feed trays 81 to 81, and feed the sheet P to the sheet conveyance path S1. The pair of feed rollers 11*b* to 11*b* and 11*c* to 11*c* feed the sheet P, transmitted thereto from the pickup rollers 11*a* to 11*a*, toward the sheet conveyance path S1.

Similarly, the pickup roller 211*a* in a sheet feed unit 210 of the sheet feed device 200 is disposed near a sheet feed side of the sheet feed device 200, picks up the sheets P one by one from the sheet feed device 200, and feeds the sheet P to the sheet conveyance path S1. The pair of feed rollers 211*b* and 211*c* feed the sheet P, transmitted thereto from the pickup roller 211*a*, toward the sheet conveyance path S1.

The registration roller 13 temporarily holds the sheet P, transmitted to the sheet conveyance path S1. Then, the registration roller 13 conveys the sheet P to a transfer nip portion between the transfer roller 10 and the intermediate transfer belt 61 in such a timing that leading edges of the toner images on the photosensitive drums 3 to 3 and a downstream side end (leading edge P1) of the sheet Pin the conveyance direction Y3 match.

The fixing unit 7 fixes the unfixed toner image on the sheet P, and includes the heat roller 71 and the pressure roller 72 that serve as fixing rollers. The heat roller 71 is drivingly rotated to convey the sheet P nipped between the heat roller 71 and the pressure roller 72 that is driven to be rotated by the rotation of the heat roller 71. The heat roller 71 is heated by a heater 71*a* disposed on an inner side, and is maintained to be at a predetermined fixing temperature based on a signal from a temperature detector 71*b*. The heat roller 71 heated by the heater 71*a* cooperates with the pressure roller 72 to thermally press the multicolor toner image, which has been transferred on the sheet P, against the sheet P. Thus, the multicolor toner image is melted, mixed, and pressed and thus is thermally fixed on the sheet P.

Components with reference numerals not described with reference to FIG. 2 will be described later.

(Sheet Feed Device)

Next, the sheet feed device 200 illustrated in FIG. 1 and FIG. 2 is described below with reference to FIG. 3 to FIG. 10.

Figure 3A:
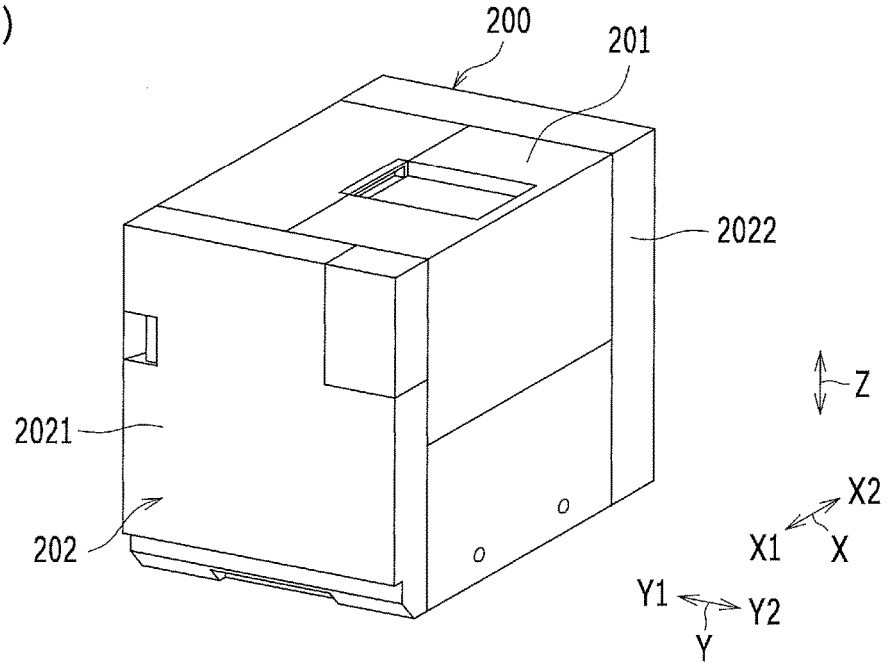
FIGS. 3(*a*)-3(*b*) are diagrams illustrating a sheet supplying operation on the sheet feed device illustrated in FIG. 1 and FIG. 2, in which FIG. 3(*a*) is a schematic perspective view illustrating a state where an openable cover is closed, and FIG. 3(*b*) is a schematic cross-sectional view schematically illustrating an internal configuration in a state where the openable cover is closed.
Figure 3B:
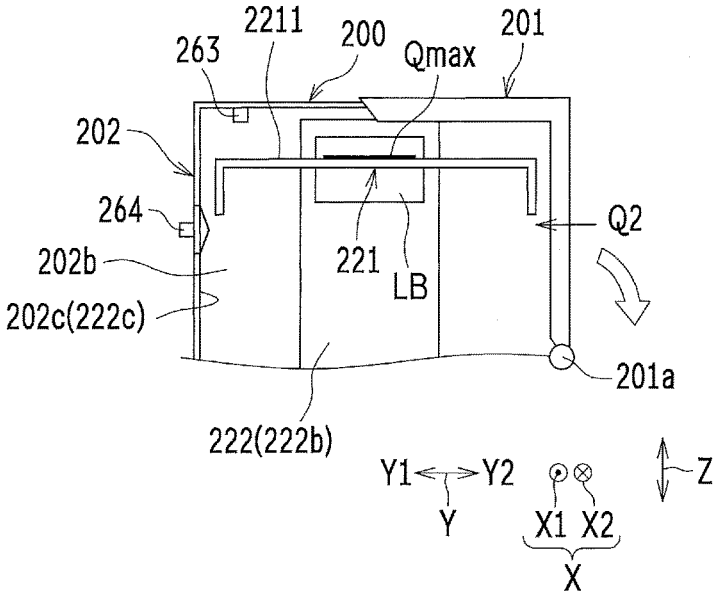
Figure 4:
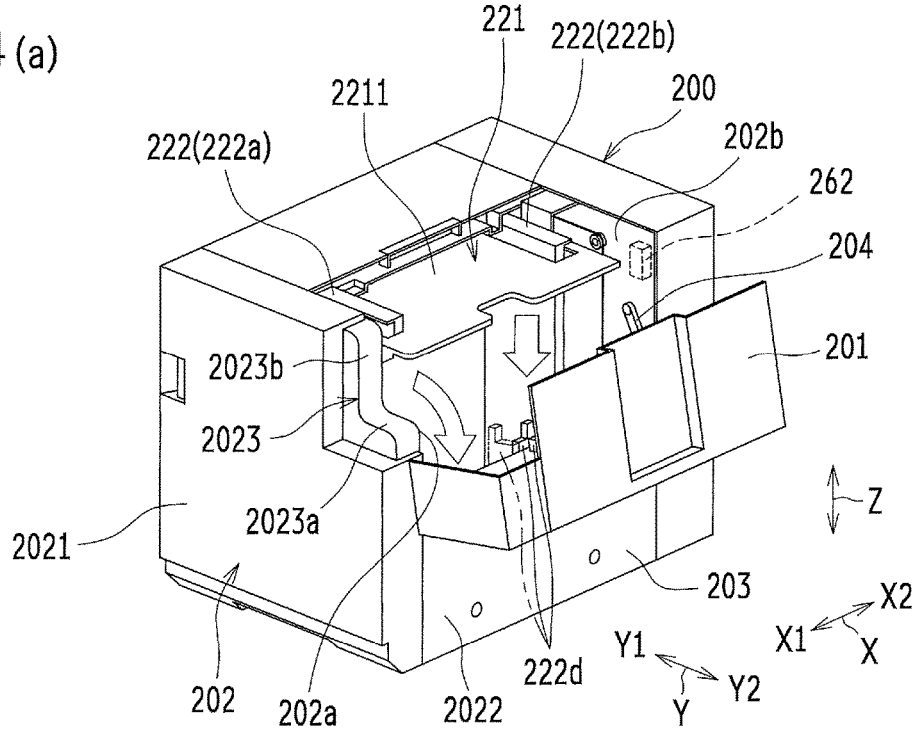
FIGS. 4(*a*)-4(*b*) are diagrams illustrating a sheet supplying operation on the sheet feed device illustrated in FIG. 1 and FIG. 2, in which FIG. 4(*a*) is a schematic perspective view illustrating the state where the openable cover is open, and FIG. 4(*b*) is a schematic cross-sectional view schematically illustrating an internal configuration in the state where the openable cover is open.
Figure 4:
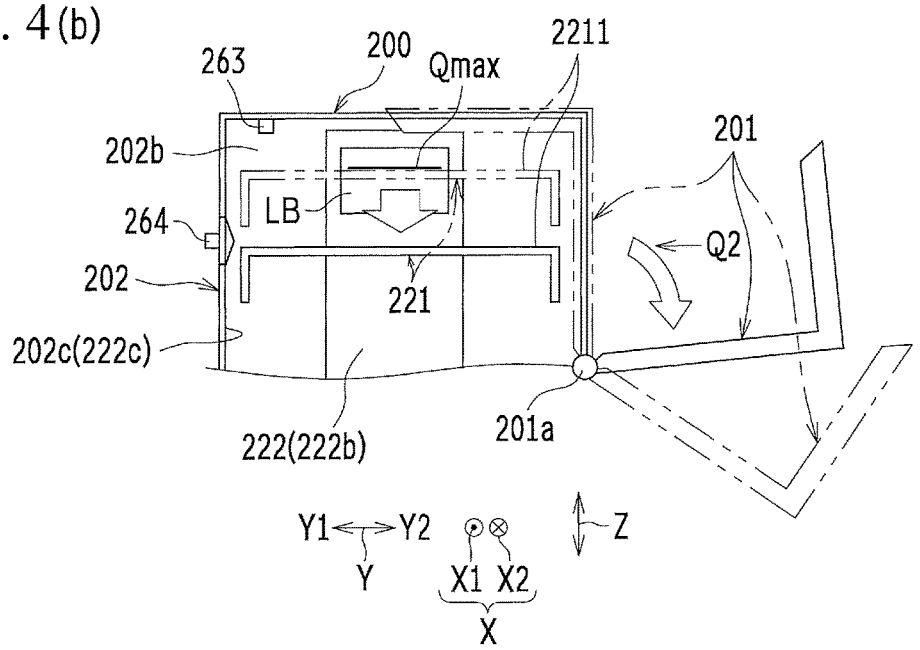
Figure 5A:
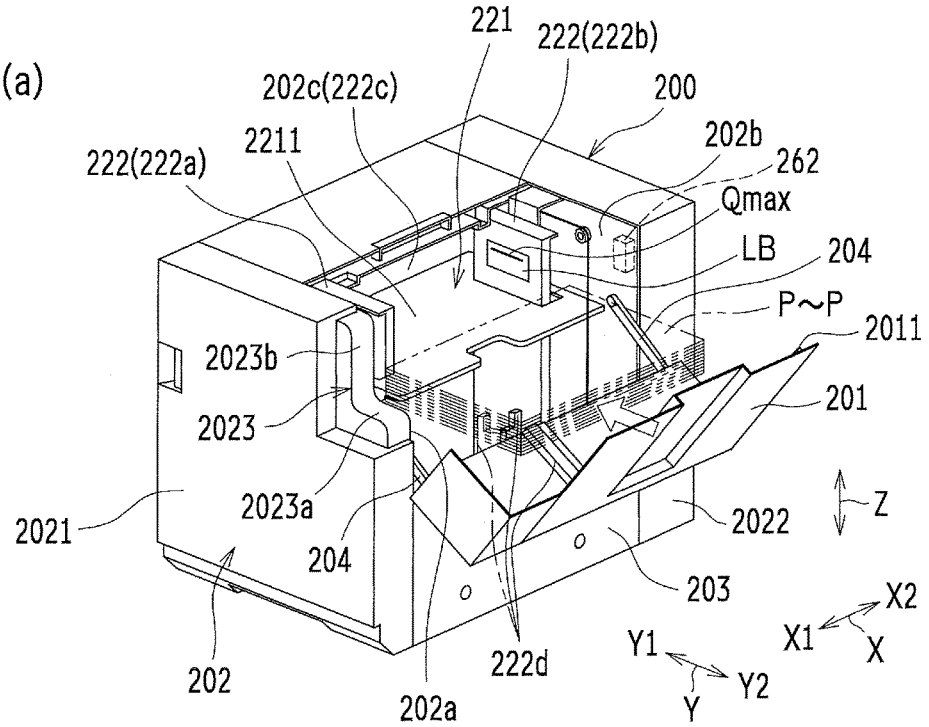
FIGS. 5(*a*)-5(*b*) are diagrams illustrating a sheet supplying operation on the sheet feed device illustrated in FIG. 1 and FIG. 2, in which FIG. 5(*a*) is a schematic perspective view illustrating a state where one bundle of sheets is supplied in the state where the openable cover is open, and FIG. 5(*b*) is a schematic cross-sectional view schematically illustrating an internal configuration in the state where one bundle of sheets is being supplied with the openable cover open.
Figure 5B:
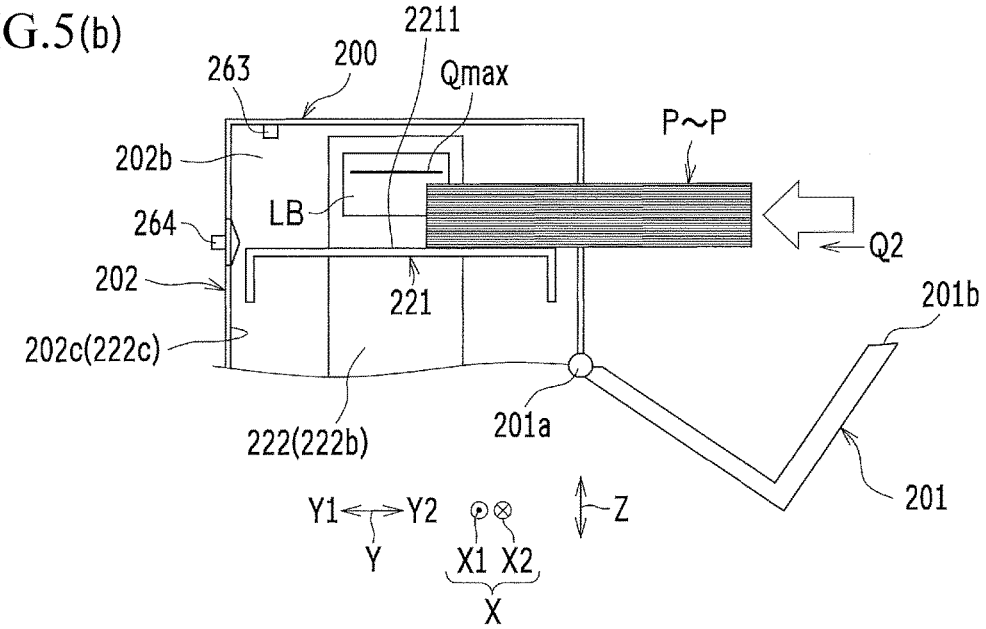

FIG. 3 to FIG. 5 are each a diagram illustrating a sheet supplying operation on the sheet feed device 200 illustrated in FIG. 1 and FIG. 2. FIG. 3A is a schematic perspective view illustrating a state where an openable cover 201 is closed. FIG. 3B is a schematic cross-sectional view schematically illustrating an internal configuration in the state where the openable cover 201 is closed. FIG. 4A is a schematic perspective view illustrating a state where the openable cover 201 is open. FIG. 4B is a schematic cross-sectional view schematically illustrating an internal configuration in the state where the openable cover 201 is open. FIG. 5A is a schematic perspective view illustrating a state where one bundle (a bundle of 500 sheets for example) of sheets P to P is supplied in the state where the openable cover 201 is open. FIG. 5B is a schematic cross-sectional view schematically illustrating an internal configuration in the state where the one bundle of sheets P to P is being supplied with the openable cover 201 open.

Figure 6:
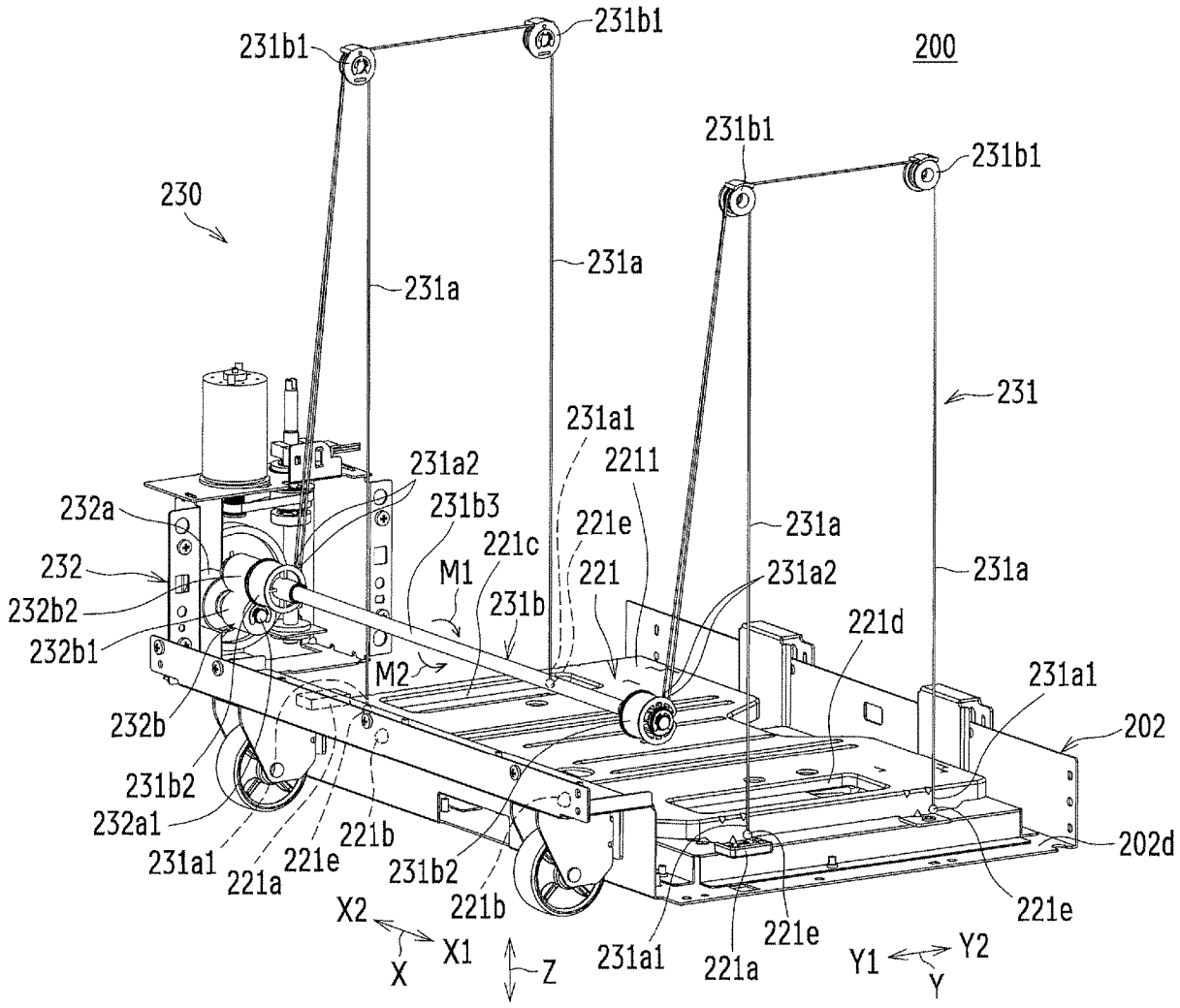
FIG. 6 is a schematic perspective view illustrating a schematic configuration of a stacking tray and a lifting/lowering device in the sheet feed device.

FIG. 6 is a schematic perspective view illustrating a schematic configuration of the stacking tray 221 and a lifting/lowering device 230 in the sheet feed device 200.

Figure 7:
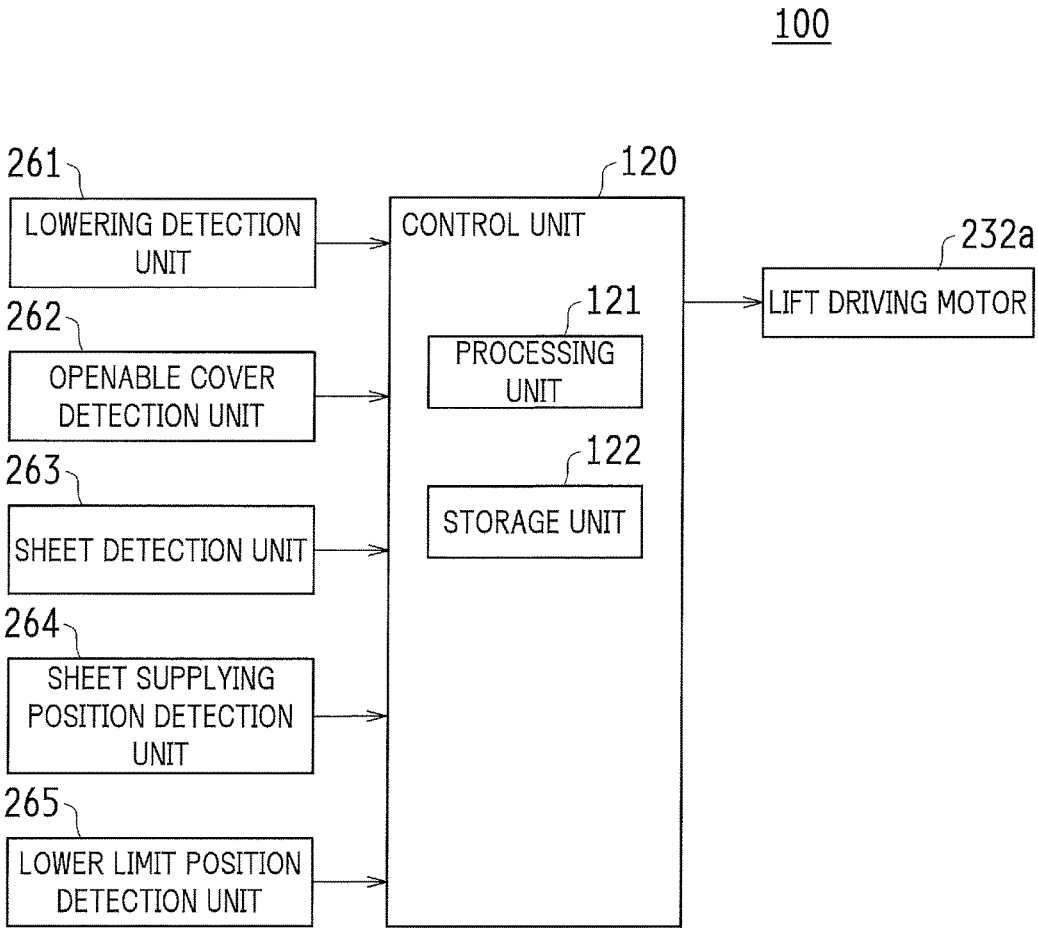
FIG. 7 is a block diagram illustrating a system configuration for performing a control operation on the sheet feed device with a control unit in the image forming apparatus.

FIG. 7 is a block diagram illustrating a system configuration for performing a control operation on the sheet feed device 200 with a control unit 120 in the image forming apparatus 100.

Figure 8A:
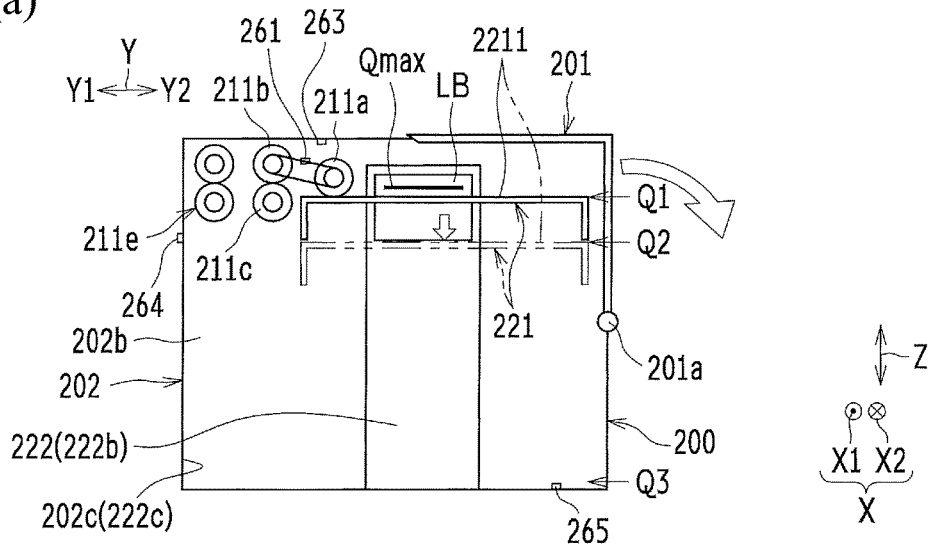
FIGS. 8(*a*)-8(*b*) are schematic cross-sectional views schematically illustrating lifted and lowered states of the stacking tray achieved by the lifting/lowering device in the sheet feed device, in which FIG. 8(*a*) illustrates a state where the openable cover is closed with no sheet P on the stacking tray, and FIG. 8(*b*) illustrates a state where an openable cover is open.
Figure 8B:
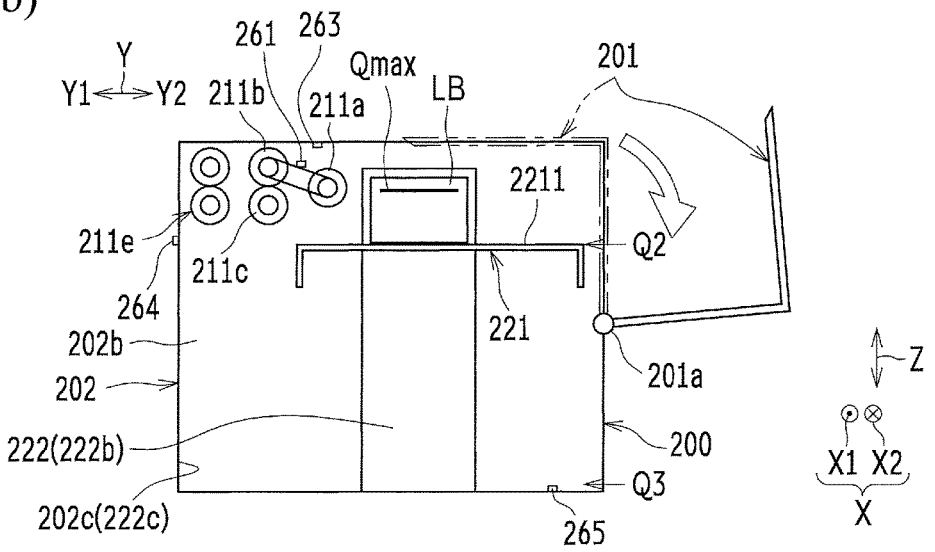
Figure 9A:
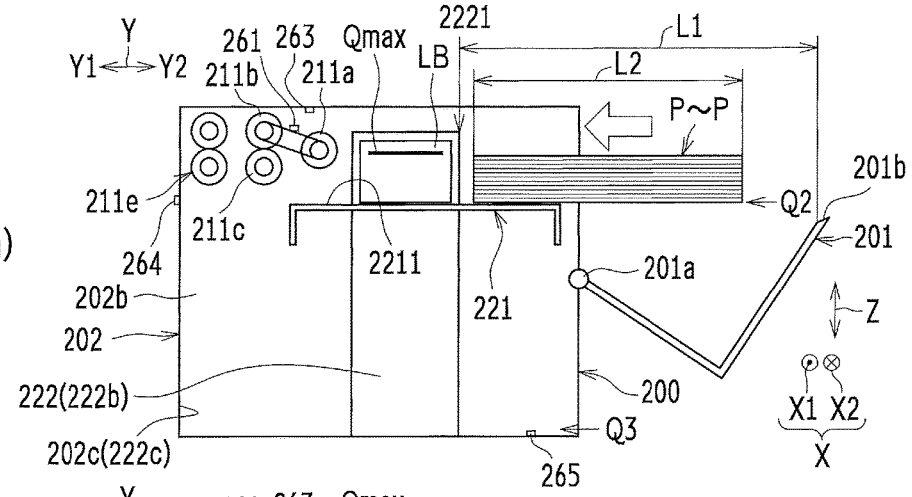
FIGS. 9(*a*)-9(*c*) are schematic cross-sectional views schematically illustrating lifted and lowered states of the stacking tray achieved by the lifting/lowering device in the sheet feed device, in which FIG. 9(*a*) illustrates a state where an operation of loading one bundle of sheets on the stacking tray is in process, FIG. 9(*b*) illustrates a state where the operation of loading one bundle of sheets on the stacking tray is completed, and FIG. 9(*c*) illustrates a state where an operation of loading a next bundle of sheets is in process, with the stacking tray lowered.
Figure 9B:
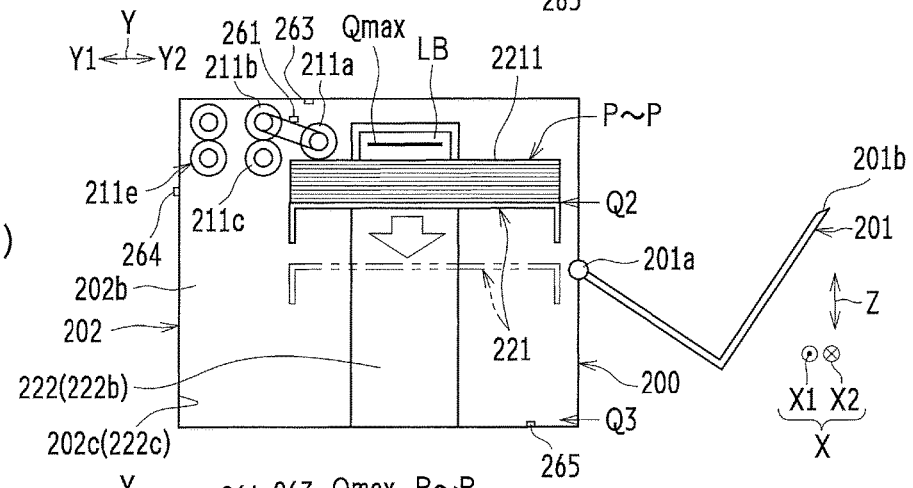
Figure 9C:
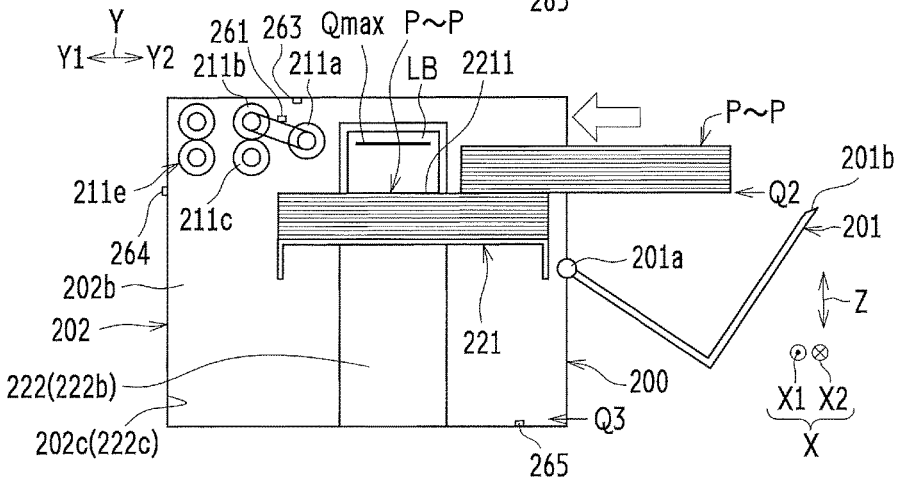

FIG. 8 and FIG. 9 are schematic cross-sectional views schematically illustrating lifted and lowered states of the stacking tray 221 achieved by the lifting/lowering device 230 in the sheet feed device 200. FIG. 8A illustrates a state where the openable cover 201 is closed with no sheet P on the stacking tray 221. FIG. 8B illustrates a state where the openable cover 201 is open. FIG. 9A illustrates a state where an operation of loading the one bundle of sheets P to P on the stacking tray 221 is in process. FIG. 9B illustrates a state where the operation of loading the one bundle of sheets P to P on the stacking tray 221 is completed. FIG. 9C illustrates a state where an operation of putting a next bundle of sheets P to P is in process, with the stacking tray 221 lowered.

Figure 10:
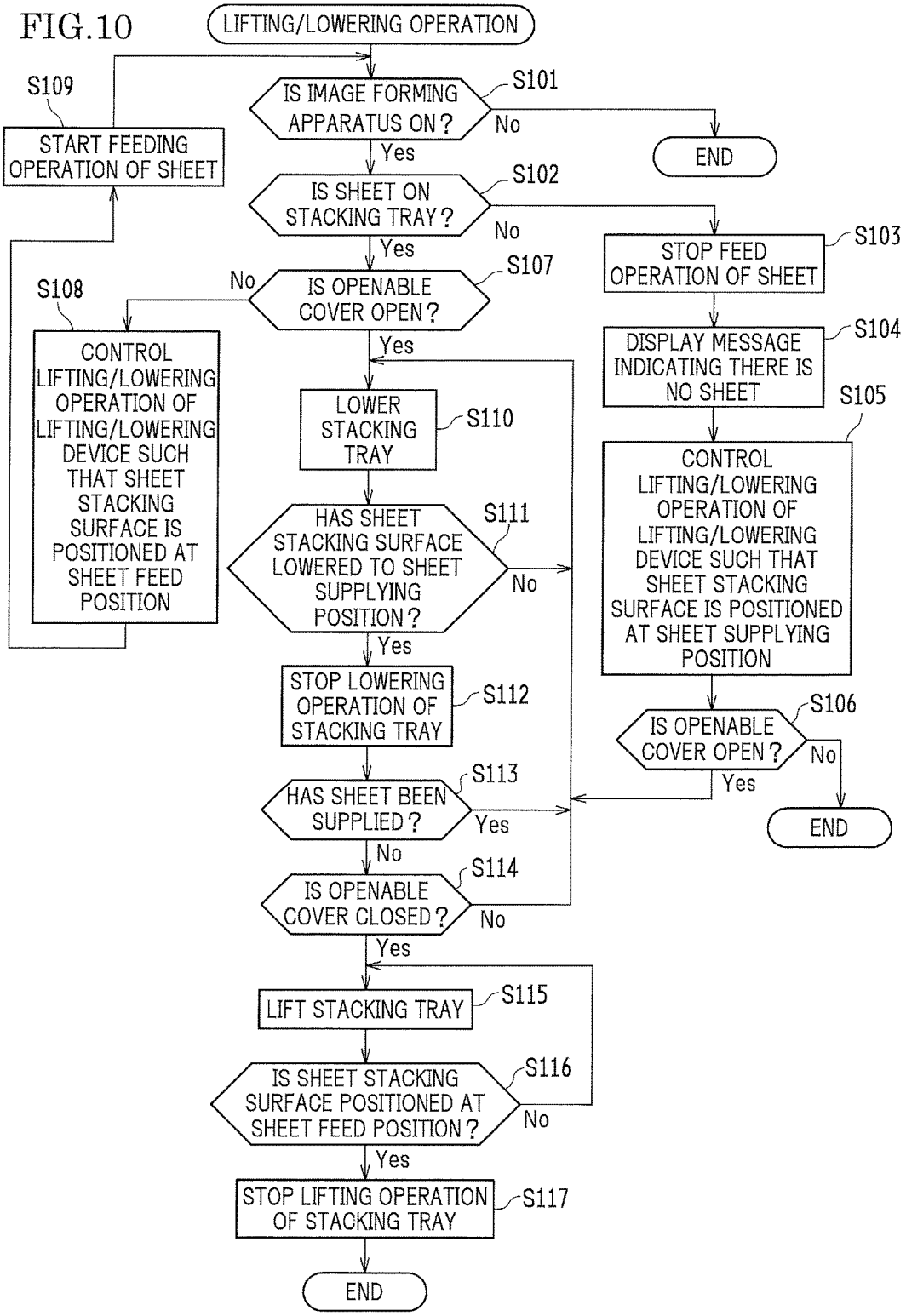
FIG. 10 is a flowchart illustrating an operation of lifting/lowering a lifting/lowering device by a control unit.

FIG. 10 is a flowchart illustrating an example of an operation of lifting/lowering the lifting/lowering device 230 by the control unit 120.

The sheet feed device 200 includes the stacking tray 221 (see FIG. 2, FIG. 3B, FIG. 4 to FIG. 6, FIG. 8, and FIG. 9), a casing 202 (see FIG. 3 to FIG. 6, FIG. 8, and FIG. 9), a positioning member 222 (see FIG. 3B, FIG. 4, FIG. 5, FIG. 8, and FIG. 9), the openable cover 201 (see FIG. 3 to FIG. 5, FIG. 8, and FIG. 9), the lifting/lowering device 230 (see FIG. 6), the pair of feed rollers 211*b* and 211*c* (see FIG. 2, FIG. 8, and FIG. 9) and a conveyance roller 211*e* (see FIG. 2, FIG. 8, and FIG. 9).

(Stacking Tray)

The stacking tray 221, on which the sheets P to P are stacked, is provided in the casing 202 in a liftable manner.

More specifically, the stacking tray 221 is provided in the casing 202 of the sheet feed device 200 in such a manner as to be movable back and forth along an upper and lower direction Z. The stacking tray 221 is a plate-shaped member extending along both predetermined depth direction X and left and right direction Y. The stacking tray 221 is a rectangular member with a longitudinal side extending in the depth direction X in plan view. The depth direction X is a direction between a front side (forward side, operation side) and a back side (rear side, side opposite to the operation side) of the sheet feed device 200. The left and right direction Y is orthogonal to both the depth direction X and the upper and lower direction Z. In this example, the depth direction X is orthogonal to a sheet feed direction Y1 of the sheets P to P stacked on the stacking tray 221, and extends along the sheet surface of the sheets P to P. The left and right direction Y extends along the sheet feed direction Y1 of the sheets P to P stacked on the stacking tray 221.

(Casing)

The casing 202 accommodates the stacking tray 221 in a liftable manner. The casing 202 has a front surface 2021 (see FIG. 3A, FIG. 4A, and FIG. 5A) as a predetermined surface in a direction orthogonal to the upper and lower direction Z (on one side in the depth direction X in this example). The sheets P to P are supplied from one side in the left and right direction Y, with respect to the front surface 2021 of the casing 202 (a side of an opposite direction Y2 with respect to the sheet feed direction Y1), that is, from a right side surface 2022 in this example (see FIG. 3A, FIG. 4A, and FIG. 5A).

More specifically, the casing 202 includes: a pair of inner walls 202*a* and 202*b* (see FIG. 3B, FIG. 4, FIG. 5, FIG. 8, and FIG. 9) arranged along both the left and right direction Y and the upper and lower direction Z with a predetermined distance provided in between; and a side wall 202*c* (FIG. 3B, FIG. 4B, FIG. 5, FIG. 8, and FIG. 9) provided on a feed side of the sheet P of the pair of inner walls 202*a* and 202*b* while extending along both the depth direction X and the upper and lower direction Z. The stacking tray 221 includes: a pair of sliding members 221*a* and 221*a* (see FIG. 6) that are provided on both ends in the depth direction X and slide on the pair of inner walls 202*a* and 202*b* of the casing 202, during the back and forth movement along the upper and lower direction Z; and a plurality of (two in this example) sliding members 221*b* to 221*b* (see FIG. 6) that are provided on one end on the feed side of the sheet P in the left and right direction Y, and slide on the side wall 202*c* of the casing 202, during the back and forth movement in the upper and lower direction Z. Thus, the stacking tray 221 can stably move back and forth along the upper and lower direction Z, with respect to the casing 202.

(Positioning Member)

The positioning member 222 positions the sheets P to P stacked on the stacking tray 221.

More specifically, the positioning member 222 includes a front side positioning member 222*a* (see FIG. 4A and FIG. 5A) and a back side positioning member 222*b* (see FIG. 3B, FIG. 4, FIG. 5, FIG. 8, and FIG. 9).

The front side positioning member 222*a* and the back side positioning member 222*b* position the sheets P to P, through restriction of movement of the sheets P to P, stacked on the stacking tray 221, toward a front side X1 and a back side X2 opposite to the front side X1.

The front side positioning member 222*a* and the back side positioning member 222*b* stand from a bottom surface 202*d* (see FIG. 6) of the casing 202 to extend in both the left and right direction Y and the upper and lower direction Z, while being separated from each other in the depth direction X by a predetermined distance (distance slight larger than the size of the sheet P in the depth direction X, due to a predetermined gap).

In this example, with the front side positioning member 222*a* and the back side positioning member 222*b*, the positioning position, in the depth direction X, can be adjusted for the sheet P of various sizes (more specifically, a A4 size, a letter size, and a B5 size).

More specifically, the casing 202 of the sheet feed device 200 is provided with fixing screw holes (not illustrated) and fixing engagement members (for example, engagement protrusions), for fixing the front side positioning member 222*a* and the back side positioning member 222*b*, arranged along the upper and lower direction Z. The front side positioning member 222*a* and the back side positioning member 222*b* are provided with a plurality of fixing screw through holes (not illustrated) that corresponding to the various sizes and are arranged in the depth direction X and fixing engagement members (for example, engagement holes) (not illustrated) that are arranged in the upper and lower direction Z. A fixing screw (not illustrated) is inserted in the fixing screw through hole corresponding to the size of the sheet P to be placed and screwed in the fixing screw hole, with the fixing screw through holes matching or substantially matching the fixing screw holes and with the fixing engagement member (for example, the engagement hole) corresponding to the size of the sheet P to be placed engaged with the fixing engagement member (for example, the engagement protrusion). In this manner, the positioning position in the depth direction X can be adjusted with the front side positioning member 222*a* and the back side positioning member 222*b*, in accordance with the size of the sheet P in the depth direction X.

The positioning member 222 further includes a feed side positioning member 222*c* (see FIG. 3B, FIG. 4B, FIG. 5, FIG. 8, and FIG. 9) and a supply side positioning member 222*d* (see FIG. 4A and FIG. 5A).

The feed side positioning member 222*c* and the supply side positioning member 222*d* position the sheets P to P, through restriction of the movement of the sheets P to P, placed on the stacking tray 221, in the sheet feed direction Y1 and in the opposite direction Y2 opposite to the sheet feed direction Y1.

The feed side positioning member 222*c* forms the side wall 202*c* provided on the feed side of the sheet P with respect to the pair of inner walls 202*a* and 202*b*. The supply side positioning member 222*d* is provided in a center portion in the depth direction X while being split to be provided on the inner surface of the openable cover 201 and on the inner surface of a side cover 203 (see FIG. 4A and FIG. 5A).

In this example, the supply side positioning members 222*d* and 222*d* are provided with the positioning position being adjustable on one side (the sheet feed direction Y1) in the left and right direction Y, in accordance with the sheet P of various sizes (more specifically, the A4 size and the B5 size).

More specifically, fixing screw holes (not illustrated), for fixing the supply side positioning members 222*d* and 222*d*, are arranged on the inner surfaces of the openable cover 201 and the side cover 203 along the left and right direction Y. The supply side positioning members 222*d* and 222*d* each have a rectangular parallelepiped shape as viewed in the upper and lower direction Z (in plan view). A fixing member (not illustrated), with which the supply side positioning members 222*d* and 222*d* are fixed in a shorter side direction, is provided with shorter side direction fixing screw through holes (not illustrated) arranged along the shorter side direction as viewed in the upper and lower direction Z (in plan view). A fixing member (not illustrated), with which the supply side positioning members 222*d* and 222*d* are fixed in a longitudinal direction, is provided with longitudinal direction fixing screw through holes (not illustrated) arranged along the longitudinal direction as viewed in the upper and lower direction Z (in plan view). When the sheet P of the maximum size is to be placed, fixing screws (not illustrated) are inserted in the shorter side direction fixing screw through holes and screwed in the fixing screw holes with the shorter side direction of the supply side positioning members 222*d* and 222*d* oriented in left and right direction Y as viewed in the upper and lower direction Z (in plan view). When the sheet P smaller than the maximum size is to be placed, the fixing screws are inserted in the longitudinal direction fixing screw through holes and screwed in the fixing screw holes with the longitudinal direction of the supply side positioning members 222*d* and 222*d* orientated in the left and right direction Y as viewed in the upper and lower direction Z (in plan view). In this manner, the positioning position in the left and right direction Y of the supply side positioning members 222*d* and 222*d* can be adjusted in accordance with the size of the sheet P in the left and right direction Y.

The stacking tray 221 is provided with insertion holes 221*c* and 221*d* (see FIG. 6) through which the front side positioning member 222*a* and the back side positioning member 222*b* are inserted. The insertion holes 221*c* and 221*d* have a predetermined size in the left and right direction Y slightly larger than the size of the front side positioning member 222*a* and the back side positioning member 222*b* in the left and right direction Y (by a predetermined distance large enough to achieve smooth movement of the front side positioning member 222*a* and the back side positioning member 222*b* in the insertion holes 221*c* and 221*d*). The insertion holes 221*c* and 221*d* have a predetermined size in the depth direction X for adjusting positioning of the front side positioning member 222*a* and the back side positioning member 222*b* in the depth direction X.

(Openable Cover)

The openable cover 201 is provided to the casing 202 in an openable manner and faces the stacking tray 221. In this example, the openable cover 201 is provided to the casing 202 in an openable manner and covers the stacking tray 221 while being in a closed state. The openable cover 201 is not limited to this configuration of covering the stacking tray 221. For example, the openable cover 201 may be provided only on a side surface side of the stacking tray 221.

The openable cover 201 is provided to a side surface (in this example, the right side surface 2022) of the casing 202 on one side in the left and right direction Y. The openable cover 201 is supported by the casing 202 in an openable manner. The openable cover 201 can be opened and closed through rotation about a rotational axis along a positioning direction (in this example, the depth direction X) for positioning the sheet P with the positioning member 222 (in this example, the front side positioning member 222*a* and the back side positioning member 222*b*).

More specifically, rotational shafts 201*a* and 201*a* (see FIG. 3B, FIG. 4B and FIG. 5B) protruding outward in the depth direction X are provided to both end portions of the openable cover 201 in the depth direction X. The rotational shafts 201*a* and 201*a* are rotatably inserted in rotation holes (not illustrated) provided to the pair of inner walls 202*a* and 202*b* of the casing 202. A pair of rotation restriction members 204 and 204 (see FIG. 4A and FIG. 5A) are provided between the openable cover 201 and the pair of inner walls 202*a* and 202*b* of the casing 202. The pair of rotation restriction members 204 and 204 prevent the openable cover 201 from rotating over a predetermined full open angle corresponding to a full open state of the openable cover 201. Thus, the full open state (see FIG. 5 and FIG. 9) is maintained with the rotation of the openable cover 201 over the full open angle prevented by the pair of rotation restriction members 204 and 204.

(Lifting/Lowering Device)

As illustrated in FIG. 6, the lifting/lowering device 230 lifts and lowers the stacking tray 221 in the casing 202. The lifting/lowering device 230 includes a lift mechanism 231 and a lift driving unit 232.

The lift mechanism 231 is configured to perform a lifting operation of lifting the stacking tray 221 and a lowering operation of lowering the stacking tray 221. The lift driving unit 232 drives the lift mechanism 231 to perform the lifting operation of the lift mechanism 231, and cancels the driving of the lift mechanism 231 so that the lift mechanism 231 is lowered with its own weight.

More specifically, the lift mechanism 231 includes: a plurality of (in this example, four) lift wires 231*a* to 231*a* with which the stacking tray 221 is suspended; and winding units 231*b* that wind the lift wires 231*a* to 231*a* with which the stacking tray 221 is suspended.

In this example, the lift wires 231*a* to 231*a* include pairs of lift wires (231*a*, 231*a*) and (231*a*, 231*a*) with one end portions 231*a*1 to 231*a*1 provided on both side surfaces of the stacking tray 221 in the depth direction X while being separated from each other by a predetermined distance in the left and right direction Y, in such a manner that the stacking tray 221 is horizontally or substantially horizontally balanced. The winding units 231*b* and 231*b* include: a pair of support pulleys 231*b*1 and 231*b*1 and a winding pulley 231*b*2 provided on the front side X1 in the depth direction X; and a pair of support pulleys 231*b*1 and 231*b*1 and the winding pulley 231*b*2 provided on the back side X2 in the depth direction X.

The pair of support pulleys (231*b*1, 231*b*1), provided on the front side X1 in the depth direction X, are rotatably provided to a pair of pivot shafts (not illustrated) provided to the casing 202 at positions higher than a pair of connection portions (221*e*, 221*e*) where the pair of lift wires (231*a*, 231*a*) on the front side X1 of the stacking tray 221 are connected. Similarly, the pair of support pulleys (231*b*1, 231*b*1), provided on the back side X2 in the depth direction X, are rotatably provided to the pair of pivot shafts (not illustrated) provided to the casing 202 at positions higher than the pair of connection portions (221*e*, 221*e*) where the pair of lift wires (231*a*, 231*a*) on the back side X2 of the stacking tray 221 are connected.

The winding pulley 231*b*2 provided on the front side X1 in the depth direction X can wind the pair of lift wires 231*a* and 231*a*, spanned by the pair of support pulleys 231*b*1 and 231*b*1 provided at above positions, with the one end portions 231*a*1 and 231*a*1 connected to the front side X1 of the stacking tray 221 and other end portions 231*a*2 and 231*a*2 connected to the winding pulley 231*b*2. Similarly, the winding pulley 231*b*2 provided on the back side X2 in the depth direction X can wind the pair of lift wires 231*a* and 231*a*, spanned by the pair of support pulleys 231*b*1 and 231*b*1 provided at above positions, with one end portions 231*a*1 and 231*a*1 connected to the back side X2 of the stacking tray 221 and the other end portions 231*a*2 and 231*a*2 connected to the winding pulley 231*b*2.

The two winding pulleys 231*b*2 and 231*b*2 provided on both sides in the depth direction X are fixed to a rotational shaft 231*b*3 rotatably disposed in the casing 202 along the depth direction X. The winding pulleys 231*b*2 and 231*b*2 rotate in a winding direction M1 (clockwise direction in FIG. 6) about the axis of the rotational shaft 231*b*3 to wind the pair of lift wires (231*a*, 231*a*) and (231*a*, 231*a*) on both sides in the depth direction X so that the stacking tray 221 can be lifted while maintaining its posture. The winding pulleys 231*b*2 and 231*b*2 rotate in a feed direction M2 (counter clockwise direction in FIG. 6), opposite to the winding direction M1, about the axis of the rotational shaft 231*b*3 to feed the pair of lift wires (231*a*, 231*a*) and (231*a*, 231*a*) on both sides in the depth direction X so that the stacking tray 221 can be lowered by its own weight while maintaining its posture.

The lift driving unit 232 includes a lift driving motor 232*a* and a lift driving force transmission mechanism 232*b*. The lift driving motor 232*a* is driven for performing the lifting/lowering operation of the lift mechanism 231. The lift driving force transmission mechanism 232*b* transmits a rotational driving force from the lift driving motor 232*a* to the lift mechanism 231.

More specifically, the lift driving motor 232*a* is provided on the back side X2 in the depth direction X, and is fixed to the casing 202 with a rotational shaft 232*a*1 extending toward the front side X1 in the depth direction X. The lift driving force transmission mechanism 232*b* is a gear train including a plurality of (in this example, two) gears 232*b*1 and 232*b*2.

More specifically, the two gears 232*b*1 and 232*b*2 are respectively fixed to the rotational shaft 232*a*1 of the lift driving motor 232*a* and to the rotational shaft 231*b*3 while meshing with the gear 232*b*1.

(Pair of Feed Rollers)

The pair of feed rollers 211*b* and 211*c* feed the sheets P stacked on the stacking tray 221, and lifted up to a predetermined sheet feed position Q1 (see FIG. 8A) by the lifting/lowering device 230, in the predetermined sheet feed direction Y1.

(Conveyance Roller)

The conveyance roller 211*e* is disposed further on the downstream side than the pair of feed rollers 211*b* and 211*c* in the sheet feed direction Y1, and feeds the sheet P, conveyed thereto by the pair of feed rollers 211*b* and 211*c*, to the image forming apparatus main body 110.

(Control Unit)

As illustrated in FIG. 7, the image forming apparatus 100 further includes the control unit 120 that is in charge of overall control of the image forming apparatus 100. The control unit 120 may be a component of the sheet feed device 200.

The control unit 120 is configured to control the lifting/lowering operation of the stacking tray 221 performed by the lifting/lowering device 230.

The control unit 120 includes: a processing unit 121 including a microcomputer such as a central processing unit (CPU); and a storage unit 122 including a nonvolatile memory such as a read only memory (ROM) and a volatile memory such as a random access memory (RAM). The control unit 120 controls operations of various components, with the processing unit 121 loading a control program, stored in the ROM of the storage unit 122 in advance, onto the RAM of the storage unit 122, and executing the control program. The RAM of the storage unit 122 provides a work area for performing an operation for the processing unit 121, and an area serving as an image memory storing therein image data.

The sheet feed device 200 includes: a lowering detection unit 261 (see FIG. 7 to FIG. 9); an openable cover detection unit 262 (see FIG. 4A, FIG. 5A and FIG. 7); a sheet detection unit 263 (see FIG. 3B, FIG. 4B, FIG. 5B and FIG. 7 to FIG. 9); a sheet supplying position detection unit 264 (see FIG. 3B, FIG. 4B, FIG. 5B, FIG. 7 to FIG. 9); and a lower limit position detection unit 265 (see FIG. 7 to FIG. 9).

The lowering detection unit 261 detects the lowering operation of the stacking tray 221 from the sheet feed position Q1, more specifically, whether a sheet stacking surface 2211 (see FIG. 3B, FIG. 4 to FIG. 6, FIG. 8, and FIG. 9) of the stacking tray 221 is positioned at the sheet feed position Q1. The lowering detection unit 261 is electrically connected to an input system of the control unit 120. Thus, the control unit 120 can detect (recognize) the lowering operation of the stacking tray 221 from the sheet feed position Q1, that is, whether the sheet stacking surface 2211 is at the sheet feed position Q1, based on a detection signal from the lowering detection unit 261. In this example, the lowering detection unit 261 is a light transmitting detection switch, provided with an actuator, is disposed near the pickup roller 211*a*, and detects a lifting/lowering position of the pickup roller 211*a* about the axis of the first feed roller 211*b*.

The openable cover detection unit 262 detects an open/closed state of the openable cover 201, more specifically, whether the openable cover 201 is open. The openable cover detection unit 262 is electrically connected to the input system of the control unit 120. Thus, the control unit 120 can detect (recognize) the open/closed state of the openable cover 201, more specifically, whether the openable cover 201 is open. In this example, the openable cover detection unit 262 is a micro switch provided to the right side surface 2022 of the casing 202, and detects whether the openable cover 201 is open with a protrusion 2011 (see FIG. 5A) provided to the openable cover 201.

The sheet detection unit 263 detects whether the sheet P is on the stacking tray 221. The sheet detection unit 263 is electrically connected to the input system of the control unit 120. Thus, the control unit 120 can detect (recognize) the sheet P on the stacking tray 221 with a detection signal from the sheet detection unit 263. In this example, the sheet detection unit 263 is a light reflecting detection switch disposed at an upper position in the casing 202. The sheet detection unit 263 irradiates the sheet P on the stacking tray 221 (when there is the sheet P) or an upper surface of the stacking tray 221 (when there is not sheet P) with light, and detects reflected light from the sheet P on the stacking tray 221 (when there is the sheet P) or the upper surface of the stacking tray 221 (when there is not sheet P).

The sheet supplying position detection unit 264 detects whether the sheet stacking surface 2211 of the stacking tray 221 is positioned higher than a predetermined sheet supplying position Q2 (see FIG. 3B, FIG. 4B, FIG. 5B, FIG. 8 and FIG. 9). The sheet supplying position detection unit 264 is electrically connected to the input system of the control unit 120. Thus, the control unit 120 can detect (recognize) whether the sheet stacking surface 2211 of the stacking tray 221 is positioned higher than the sheet supplying position Q2 with a detection signal from the sheet supplying position detection unit 264. In this example, the sheet supplying position detection unit 264 is a light transmitting detection switch, provided with an actuator, positioned at a threshold position in the casing 202 for determining whether the sheet stacking surface 2211 is higher or lower than the sheet supplying position Q2 of the casing 202. The sheet supplying position detection unit 264 detects whether the sheet stacking surface 2211 of the stacking tray 221 is higher than the threshold position. The sheet supplying position detection unit 264 may have a conventional configuration, and thus the detailed description thereof will be omitted herein.

The lower limit position detection unit 265 detects a lower limit position Q3 (see FIG. 8 and FIG. 9) of the stacking tray 221. The lower limit position detection unit 265 is electrically connected to the input system of the control unit 120. Thus, the control unit 120 can detect (recognize) the lower limit position Q3 of the stacking tray 221 with a detection signal from the lower limit position detection unit 265. In this example, the lower limit position detection unit 265 is a light transmitting detection switch, provided with an actuator, disposed on the bottom surface of the casing 202. The lower limit position detection unit 265 detects whether the stacking tray 221 has reached the lower limit position Q3.

The sheet feed device 200 has a sheet stacking upper limit position Qmax (see FIG. 3B, FIG. 4B, FIG. 5B, FIG. 8 and FIG. 9) displayed thereon. The sheet stacking upper limit position Qmax represents a warning indicating that the sheets P to P exceeding the maximum stacked amount cannot be stacked on the stacking tray 221. In this example, a label LB indicating the sheet stacking upper limit position Qmax (see FIG. 3B, FIG. 4B, FIG. 5B, FIG. 8 and FIG. 9) is attached on the inner side surface of the back side positioning member 222*b*.

(Example of Controlling Lifting/Lowering Operation of Lifting/Lowering Device)

Next, an example of controlling the lifting/lowering operation of the lifting/lowering device 230 performed by the control unit 120 is described below with reference to FIG. 8 to FIG. 10.

As illustrated in FIG. 10, the lifting/lowering device 230 performs the lifting/lowering operation in the following manner. First of all, when the image forming apparatus 100 is ON (step S101: Yes), the control unit 120 determines whether the sheet P is on the stacking tray 221, based on the detection by the sheet detection unit 263 (step S102). When it is determined that there is no sheet P on the stacking tray 221 (step S102: No), the feed operation of the sheet P is stopped (step S103), and a message indicating that there is no sheet is displayed (step S104). The control unit 120 controls the lifting/lowering operation of the lifting/lowering device 230 in such a manner that the sheet stacking surface 2211 is positioned at the sheet supplying position Q2, with the sheet supplying position detection unit 264 (step S105) (see FIG. 8A), and determines whether the openable cover 201 is open based on the detection by the openable cover detection unit 262 (step S106). When the control unit 120 determines that the openable cover 201 is open (step S106: Yes), the processing proceeds to step S110 (see FIG. 8B).

Upon determining that there is the sheet P on the stacking tray 221 (step S102: Yes), the control unit 120 determines whether the openable cover 201 is open, based on the detection by the openable cover detection unit 262 (step S107). Upon determining that the openable cover 201 is closed (step S107: No), the control unit 120 controls the lifting/lowering operation of the lifting/lowering device 230 in such a manner that the sheet stacking surface 2211 is positioned at the sheet feed position Q1 based on the detection by the lowering detection unit 261 (step S108), and starts the feeding operation of the sheet P (step S109). Then, the processing proceeds to step S101. When the control unit 120 determines that the openable cover 201 is open (step S107: Yes), the processing proceeds to step S110.

Next, the control unit 120 causes the lifting/lowering device 230 to lower the stacking tray 221 (step S110), and detects whether the sheet stacking surface 2211 has lowered to the sheet supplying position Q2 based on the detection by the sheet supplying position detection unit 264 (step S111). When the control unit 120 determines that the sheet stacking surface 2211 has not lowered to the sheet supplying position Q2 (step S111: No), the processing proceeds to step S110 (see FIG. 9A and FIG. 9C). Upon determining that the sheet stacking surface 2211 has lowered to the sheet supplying position Q2 (step S111: Yes), the control unit 120 stops the lowering operation of the stacking tray 221 performed by the lifting/lowering device 230 (step S112).

Next, the control unit 120 determines whether the sheet P has been supplied (step S113). When the control unit 120 determines that the sheet P has been supplied (step S113: Yes), the processing proceeds to step S110. When the control unit 120 determines that the sheet P has not been supplied (step S113: No), the processing proceeds to step S114.

Next, the control unit 120 determines whether the openable cover 201 is closed based on the detection by the openable cover detection unit 262 (step S114). When the control unit 120 determines that the openable cover 201 is open (step S114: No), the processing proceeds to step S110. Upon determining that the openable cover 201 is closed (step S114: Yes), the control unit 120 causes the lifting/lowering device 230 to lift the stacking tray 221 (step S115).

Next, the control unit 120 determines whether the sheet stacking surface 2211 is positioned at the sheet feed position Q1 based on the detection by the sheet supplying position detection unit 264 (step S116). When the sheet stacking surface 2211 is not positioned at the sheet feed position Q1 (step S116: No), the processing proceeds to step S115. When the sheet stacking surface 2211 is positioned at the sheet feed position Q1 (step S116: Yes), the control unit 120 stops the lifting operation of the stacking tray 221 by the lifting/lowering device 230 (step S117).

The control unit 120 terminates the processing when the image forming apparatus 100 is turned OFF (step S101: No).

In the example of the control illustrated in FIG. 10, the lifting/lowering operation of the stacking tray 221 is controlled in such a manner that the sheet stacking surface 2211 is positioned at the sheet supplying position Q2, when the openable cover 201 is closed with no sheet P on the stacking tray 221. Alternatively, the lifting/lowering operation of the stacking tray 221 may be controlled in such a manner that the sheet stacking surface 2211 is maintained at the sheet feed position Q1 or is positioned at a position below the sheet supplying position Q2 (for example, the lower limit position Q3). When the sheet stacking surface 2211 is maintained to be at the sheet feed position Q1, the lifting/lowering operation of the stacking tray 221 may be controlled in such a manner that the sheet stacking surface 2211 is lowered from the sheet feed position Q1 to the sheet supplying position Q2 in response to the opening of the openable cover 201. When the sheet stacking surface 2211 is positioned at a lower position below the sheet supplying position Q2, the lifting/lowering operation of the stacking tray 221 may be controlled in such a manner that the sheet stacking surface 2211 is lifted from the lower position (for example, the lower limit position Q3) to be positioned at the sheet supplying position Q2 in response to the opening of the openable cover 201.

The basic operation of the image forming apparatus 100 and the sheet feed device 200 according to the embodiment is as described above. The configuration and the operation of the sheet feed device 200, as the feature of the present invention, are described more in detail below.

First Embodiment

A first embodiment of the present invention is described in detail below with reference to the drawings.

Figure 11:
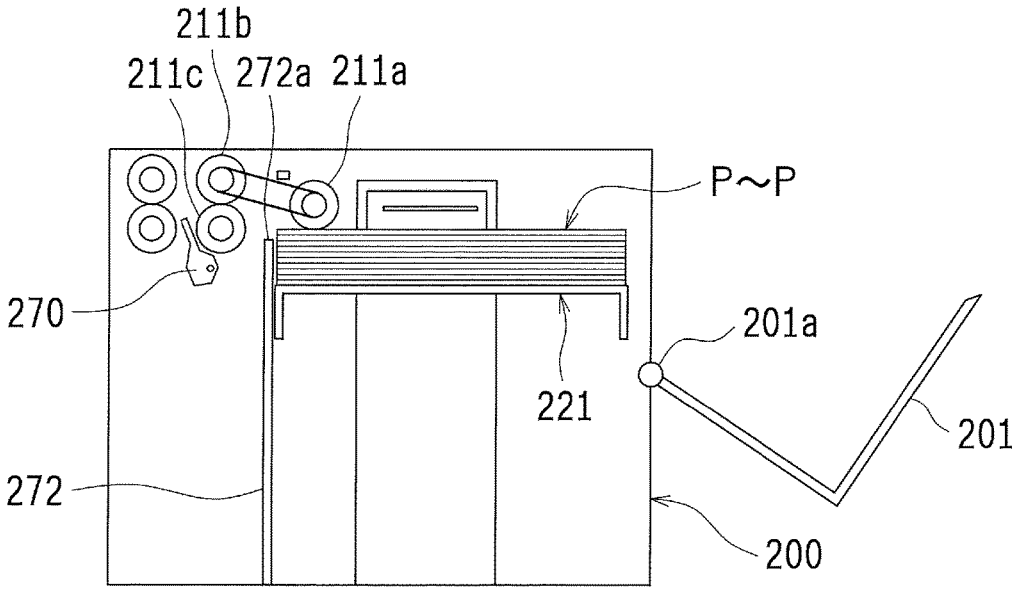
FIG. 11 is a schematic cross-sectional view schematically illustrating an internal configuration of a sheet feed device according to a first embodiment.

As illustrated in FIG. 11, the sheet feed device 200 according to the first embodiment includes a pressing lever (pressing member) 270 at a position near the feed rollers (paper feed rollers) 211*b* and 211*c*. When the sheet conveyance stops with the sheet P nipped by the feed rollers 211*b* and 211*c* because the user has opened the openable cover 201 of the sheet feed device 200 while the sheet feed operation is in process, the pressing lever 270 presses back the sheet P nipped by the feed rollers 211*b* and 211*c* toward the stacking tray 221. Thus, the sheet P does not remain nipped by the feed rollers 211*b* and 211*c* when the user opens the openable cover 201, while the sheet feed operation by the sheet feed device 200 is in process, to supply the sheet P. Thus, the sheet supplying operation on the stacking tray 221 is not hindered.

Figure 12A:
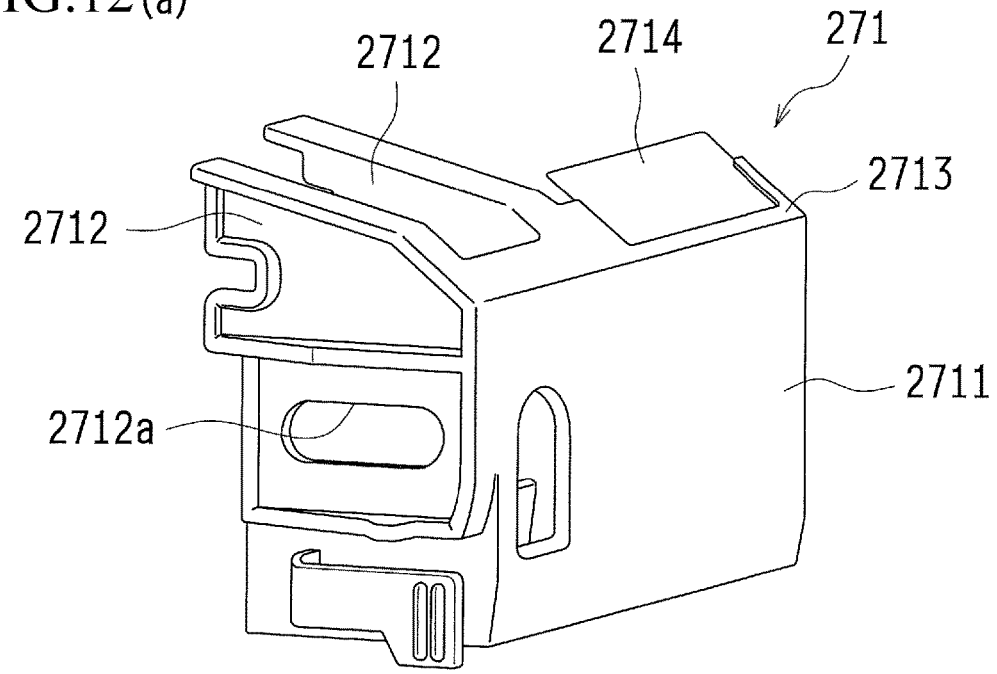
FIG. 12(*a*) is a perspective view illustrating a maintenance cover for the sheet feed device, and FIG. 12(*b*) is a perspective view illustrating a pressing lever.

The pressing lever 270 is attached to a maintenance cover (holding member) 271 illustrated in FIG. 12A (not illustrated in FIG. 11), and is detachably attached to the sheet feed device 200 together with the maintenance cover 271. The sheet feed device 200 according to the first embodiment has a side wall 272 disposed on the downstream side of the stacking tray 221 in a sheet conveyance direction. The maintenance cover 271 is detachably attached to a portion near one end portion of an upper edge portion of the side wall 272.

The maintenance cover 271 roughly includes a main plate 2711 and two side plates 2712 and 2712. The main plate 2711 is in flush with the side wall 272 when the maintenance cover 271 is attached to the sheet feed device 200. The side plates 2712 and 2712 protrude from the main plate 2711 toward the downstream side in the sheet conveyance direction. The pressing lever 270 is disposed between the side plates 2712 and 2712. More specifically, the side plates 2712 and 2712 are each provided with a shaft hole 2712*a*. The pressing lever 270 has a rotational shaft 2701*a* (see FIG. 12B) rotatably held by the shaft holes 2712*a* and 2712*a*. In FIG. 12A, the shaft holes 2712*a* and 2712*a* are illustrated as an elongated hole with which the pressing lever 270 can be easily attached to the maintenance cover 271. The shaft holes 2712*a* and 2712*a* do not necessarily need to be the elongated hole, and may be a circular hole.

Figure 12B:
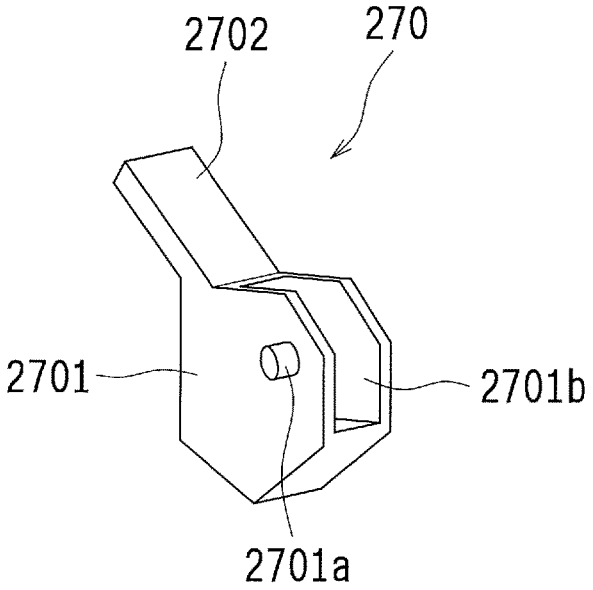

As illustrated in FIG. 12B, the pressing lever 270 includes: a main body portion 2701 and a lever portion 2702 formed to protrude from the main body portion 2701. The main body portion 2701 is provided with the rotational shafts 2701*a* and a groove portion 2701*b*. The rotational shafts 2701*a* protrude outward from both side surfaces of the main body portion 2701, and are not provided in the groove portion 2701*b*.

Figure 13:
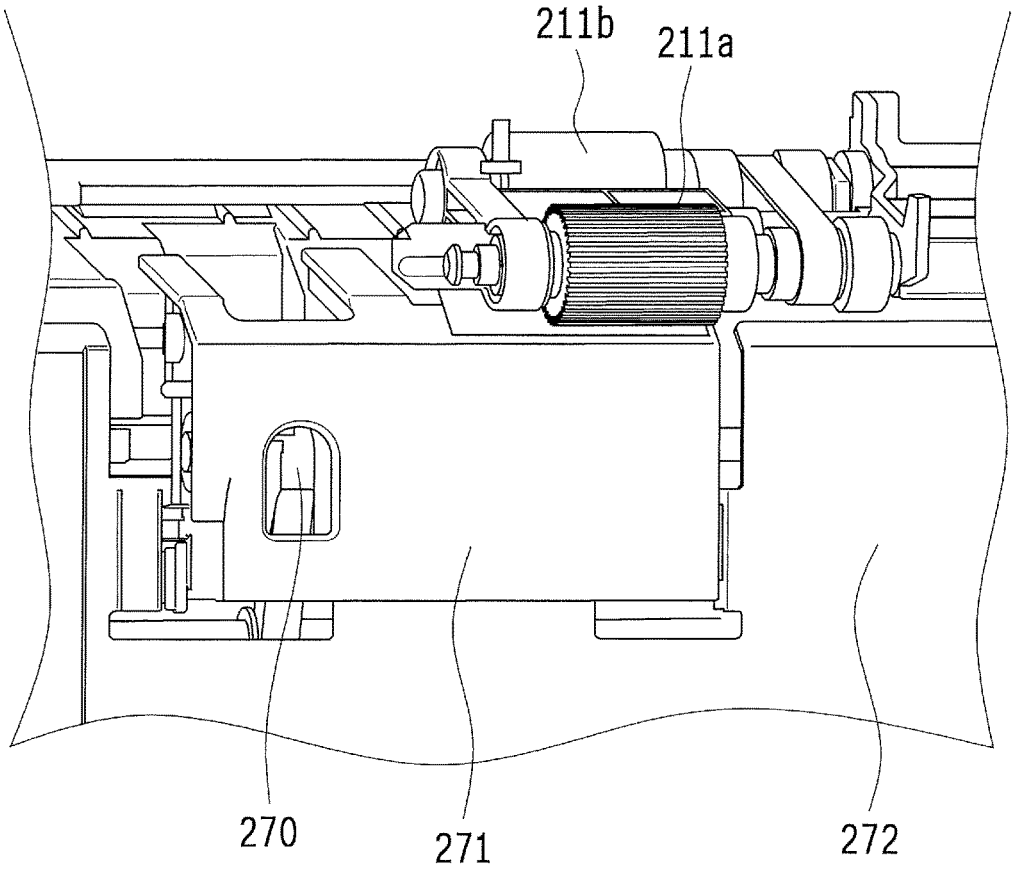
FIG. 13 is a perspective view illustrating a state where the maintenance cover is attached to the sheet feed device.

The side wall 272 functions as a positioning member on the downstream side of the sheet bundle on the stacking tray 221 in the sheet conveyance direction. The side wall 272 has an upper edge portion 272*a* as an opening edge portion through which the sheet P picked up by the pickup roller 211*a* is sent toward the feed rollers 211*b* and 211*c*. The feed rollers 211*b* and 211*c* in the sheet feed device 200 require maintenance. The maintenance cover 271 is removed from the side wall 272 when the maintenance is performed on the feed rollers 211*b* and 211*c*. Thus, a service man can put his hand to the inner side of the side wall 272 through a portion where the maintenance cover 271 has been removed, and thus the maintenance can be easily performed on the feed rollers 211*b* and 211*c*. FIG. 13 is a perspective view illustrating a state where the maintenance cover 271 is attached to the sheet feed device 200.

The pressing lever 270 is attached to the maintenance cover 271, and thus can be removed from the sheet feed device 200 together with the maintenance cover 271. Thus, the pressing lever 270 does not hinder the maintenance on the feed rollers 211*b* and 211*c*.

The maintenance cover 271 may include a guide member 2713 (see FIG. 12A) that guides the sheet P on the stacking tray 221 to the feed rollers 211*b* and 211*c*. A transparent sheet 2714 (see FIG. 12A), with which guiding of the sheet P being conveyed to the nip portion between the feed rollers 211*b* and 211*c* is ensured, may be attached to the guide member 2713. The maintenance cover 271 provided with the guide member 2713 can have a large size in a sheet width direction. Thus, with the maintenance cover 271 with a large size removed, the maintenance can be even more easily performed on the feed rollers 211*b* and 211*c*.

Figure 14:
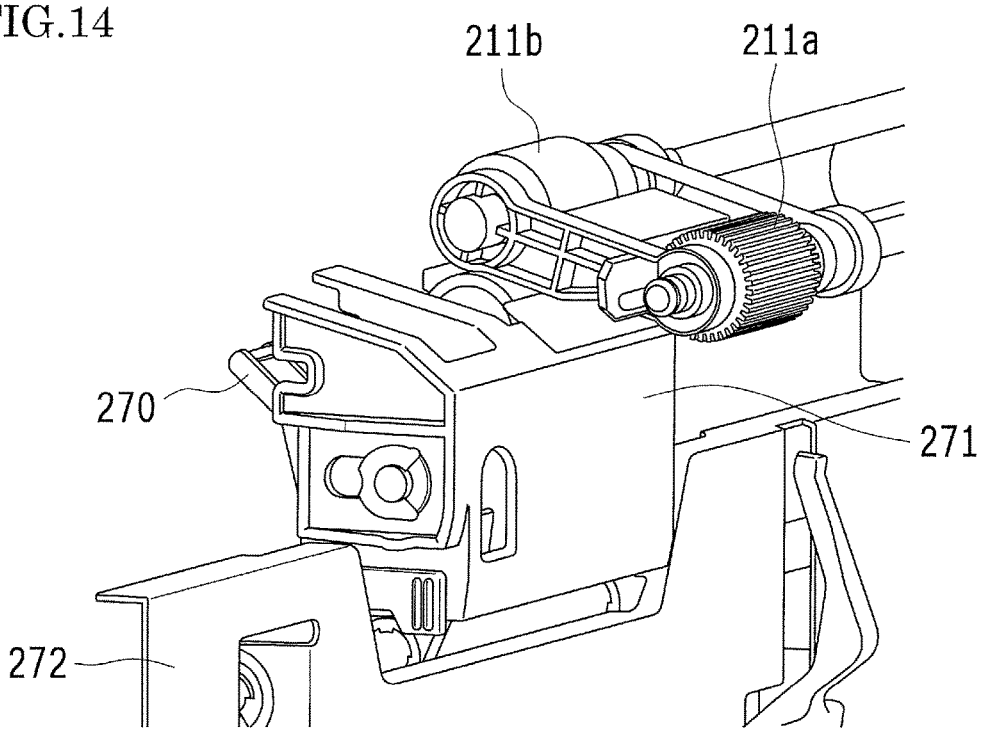
FIG. 14 is a perspective view illustrating a configuration around feed rollers, as viewed from an upstream side in a sheet conveyance direction.
Figure 15:
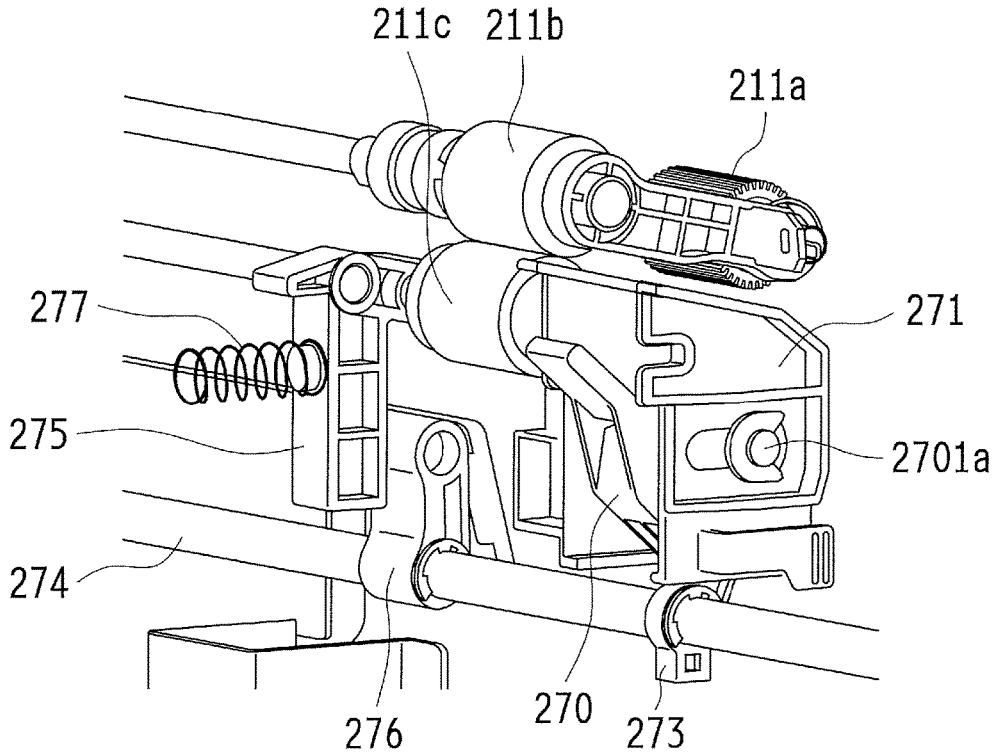
FIG. 15 is a perspective view illustrating the configuration around the feed rollers, as viewed from a downstream side in the sheet conveyance direction.
Figure 16A:
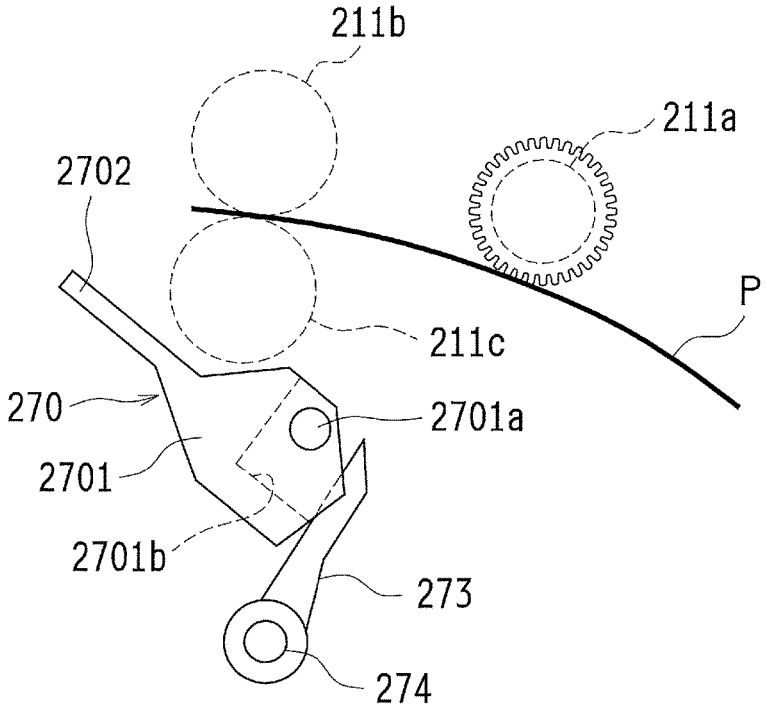
FIG. 16(*a*) illustrates a state where a pressing lever is at a standby position and FIG. 16(*b*) illustrates a state where the pressing lever is performing an operation of pressing a sheet.
Figure 16B:
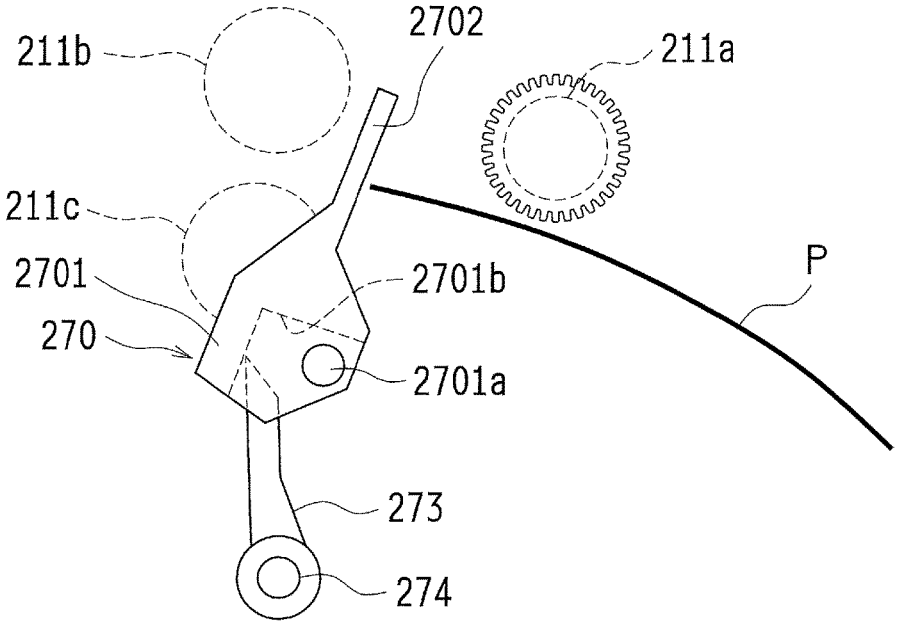

Next, the configuration and the operation of the pressing lever 270 are described with reference to FIG. 14, FIG. 15, and FIGS. 16A and 16B. FIG. 14 is a perspective view of a configuration around the feed rollers 211*b* and 211*c*, as viewed from the upstream side of the sheet conveyance direction. FIG. 15 is a perspective view illustrating the configuration around the feed rollers 211*b* and 211*c*, as viewed from the downstream side of the sheet conveyance direction. FIG. 16A illustrates a state where the pressing lever 270 is at a standby position. FIG. 16B illustrates a state where the pressing lever 270 is performing an operation of pressing the sheet P. In FIGS. 16A and 16B, the maintenance cover 271 is omitted so that the operation of the pressing lever 270 can be more easily understood.

As illustrated in FIG. 16A, the pressing lever 270 in the standby state stands by at a position where the lever portion 2702 does not hinder the conveyance of the sheet P. The pressing lever 270 in the standby state stays still with a portion of the main body portion 2701 in contact with a first lever 273. The first lever 273 is used for switching the pressing lever 270 from the standby position to a sheet pressing back position (see FIG. 16B), and pivots about a driving shaft 274. The first lever 273 and the driving shaft 274 are not disposed on the maintenance cover 271, and are disposed on the main body of the sheet feed device 200.

When the pressing lever 270 performs the operation of pressing the sheet P, driving force from a driving unit such as a motor is transmitted to the driving shaft 274, and the driving shaft 274 makes the first lever 273 pivot to the position illustrated in FIG. 16B. In this process, the first lever 273 moves while being in contact with an inner wall surface of the groove portion 2701*b* of the pressing lever 270, and thus the pressing lever 270 pivots about the rotational shaft 2701*a*. Thus, the lever portion 2702 of the pressing lever 270 moves from the downstream side to the upstream side in the conveyance direction, on a conveyance path for the sheet P, beyond the nip position between the feed rollers 211*b* and 211*c*. Thus, the leading edge of the sheet P remaining nipped between the feed rollers 211*b* and 211*c* is pressed back toward the stacking tray 221 by the lever portion 2702.

After the pressing lever 270 has pressed the sheet P back to the stacking tray 221, the first lever 273 returns to the standby position illustrated in FIG. 16A. The pressing lever 270 pivots by its own weight to return to the standby position. Alternatively, a configuration may be employed in which the pressing lever 270 returns to the standby position with pressing force from an elastic member and the like acting on the pressing lever 270.

In the configuration described above, the driving force for operating the pressing lever 270 is transmitted from the driving shaft 274 to the pressing lever 270 via the first lever 273, due to the engagement between the first lever 273 and the pressing lever 270. Thus, the driving force can be easily transmitted to the pressing lever 270 detachably attached to the sheet feed device 200.

Figure 17A:
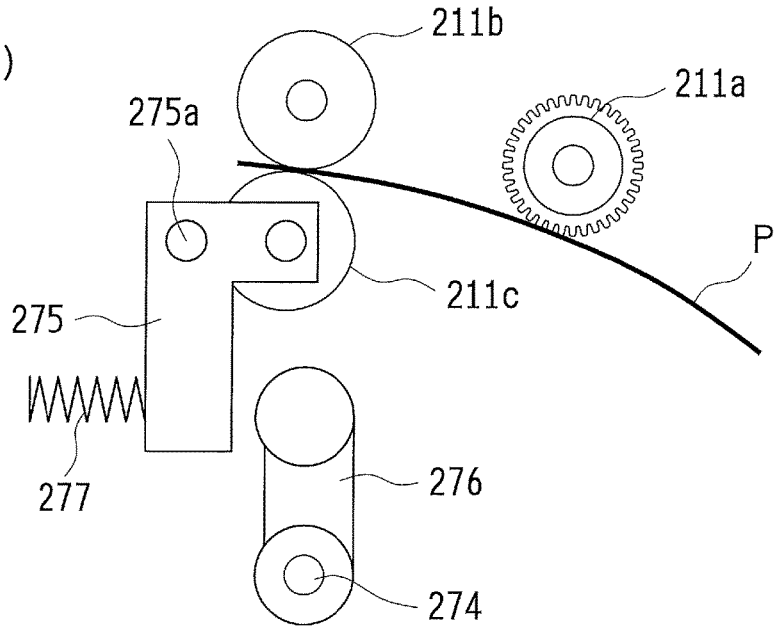
FIG. 17(*a*) illustrates a state of a roller separating mechanism when the pressing lever is at the standby position, and FIG. 17(*b*) illustrates a state of the roller separating mechanism when the pressing lever is performing the operation of pressing the sheet.
Figure 17B:
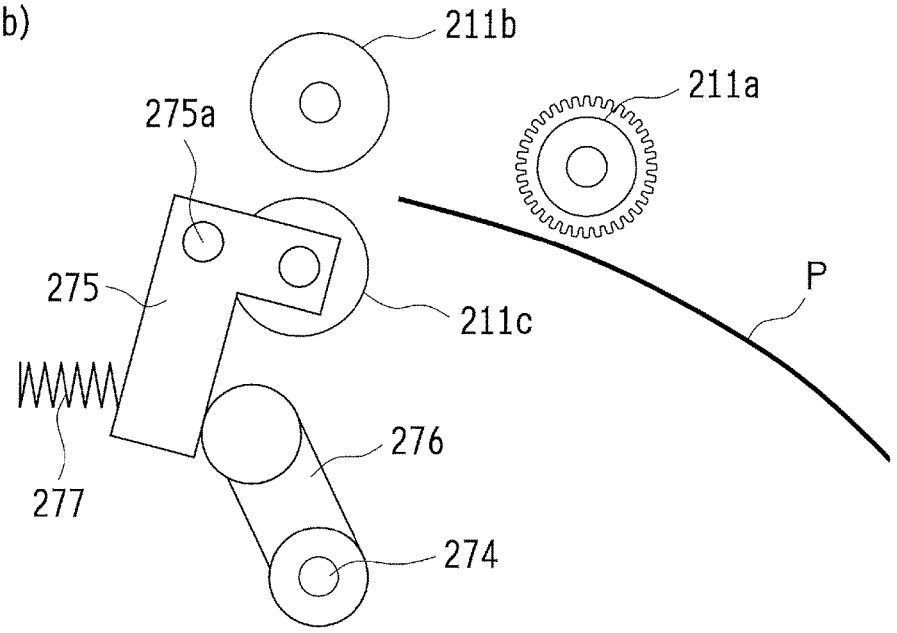

When the pressing lever 270 performs the pressing operation on the sheet P, the feed rollers 211*b* and 211*c*, defining the nip portion therebetween, need to be separated from each other so that the sheet P can be moved. Thus, the sheet feed device 200 according to the first embodiment further includes a roller separating mechanism for the feed rollers 211*b* and 211*c*. The configuration and the operation of the roller separating mechanism are described with reference to FIGS. 17A and 17B. FIG. 17A illustrates a state of the roller separating mechanism when the pressing lever 270 is at the standby position. FIG. 17B illustrates a state of the roller separating mechanism when the pressing lever 270 is performing the operation of pressing the sheet P. In FIGS. 17A and 17B, the maintenance cover 271 is omitted so that the operation of the roller separating mechanism can be more easily understood.

As illustrated in FIGS. 17A and 17B, the roller separating mechanism includes a roller holding member 275, a second lever 276, and an elastic member 277.

The roller holding member 275 holds the rotational shaft of the feed roller 211*c* as one of the feed rollers 211*b* and 211*c*, and is rotatably supported by a rotational shaft 275*a* fixed to the main body of the sheet feed device 200.

The second lever 276 is used for switching the roller holding member 275 between a roller contact position (see FIG. 17A) and a roller separation position (see FIG. 17B), and pivots about the driving shaft 274. Thus, the second lever 276 shares the driving shaft 274 with the first lever 273, whereby a simple configuration is achieved. However, the present invention is not limited to this, and the second lever 276 and the first lever 273 may be driven by different driving shafts.

The elastic member 277 applies pressing force to the roller holding member 275 to make the roller holding member 275 stay at the roller contact position in the state illustrated in FIG. 17A. In the example illustrated in FIG. 17, the elastic member 277 is a compression coil spring. However, the present invention is not limited to this, and the elastic member 277 may be other elastic members such as a tension spring or a leaf spring.

When the pressing lever 270 performs the operation of pressing the sheet P, the driving shaft 274 makes the first lever 273 pivot to the position illustrated in FIG. 16B, and at the same time, makes the second lever 276 pivot to the position illustrated in FIG. 17B. Thus, the second lever 276 applies rotational force, against the pressing force of the elastic member 277, to the roller holding member 275, whereby the roller holding member 275 switches to the roller separation position. When the roller holding member 275 switches to the roller separation position, the feed roller 211*c* moves, whereby the feed rollers 211*b* and 211*c*, defining the nip portion therebetween, are separated from each other.

As described above, the feed rollers 211*b* and 211*c*, defining the nip portion therebetween, are separated from each other when the pressing lever 270 performs the operation of pressing the sheet P. This ensures that the sheet P will be pressed back to the stacking tray 221 by the pressing lever 270.

Preferably, the sheet pressing operation by the pressing lever 270 and the roller separating operation by the roller separating mechanism are performed at slightly different timings, with the sheet pressing operation performed after the roller separating mechanism. Thus, the sheet pressing operation is guaranteed, without being hinder by the sheet being nipped between the feed rollers 211*b* and 211*c*. In the configuration in which the first lever 273 and the second lever 276 share the driving shaft 274, the two different operation timings can be easily achieved with the disposed angles of the first lever 273 and the second lever 276 appropriately designed.

In the sheet feed device 200 according to the first embodiment, the sheet pressing operation by the pressing lever 270 is preferably performed at predetermined timings described below.

First of all, a first example is described. Specifically, the sheet pressing operation can be performed at a timing at which the sheet P may still be nipped between the feed rollers 211*b* and 211*c*. In this first example, whether the sheet is nipped between the feed rollers 211*b* and 211*c* is not detected, and thus the sheet pressing operation may be performed with the sheet P not being nipped.

In the first example, the sheet pressing operation is performed at at least one of:

(1) a timing at which a print job is terminated; and (2) a timing at which opening of the openable cover 201 is detected.

At the timing (1), the sheet P may still be nipped due to double feed or the sheet P corresponding to the subsequent job may still be nipped. Thus, the sheet pressing operation is preferably performed just to be sure. The timing at which a print job is terminated may be any one of: a timing at which the sheet P is discharged from the image forming apparatus 100 (this timing can be detected by a sheet output sensor disposed near the discharge roller 31); and a timing at which the sheet P is discharged from the sheet feed device (this timing can be detected by a sheet output sensor disposed near the conveyance roller 211*e*).

At the timing (2), the sheet P under the feeding operation when the openable cover 201 is opened continues to be fed. Still, the sheet P may still be nipped due to double feed or the sheet P corresponding to the subsequent job may still be nipped, as in the case of the timing (1), and thus the sheet pressing operation is preferably performed just to be sure. The timing at which the openable cover 201 is opened can be detected by the openable cover detection unit 262.

Figure 18:
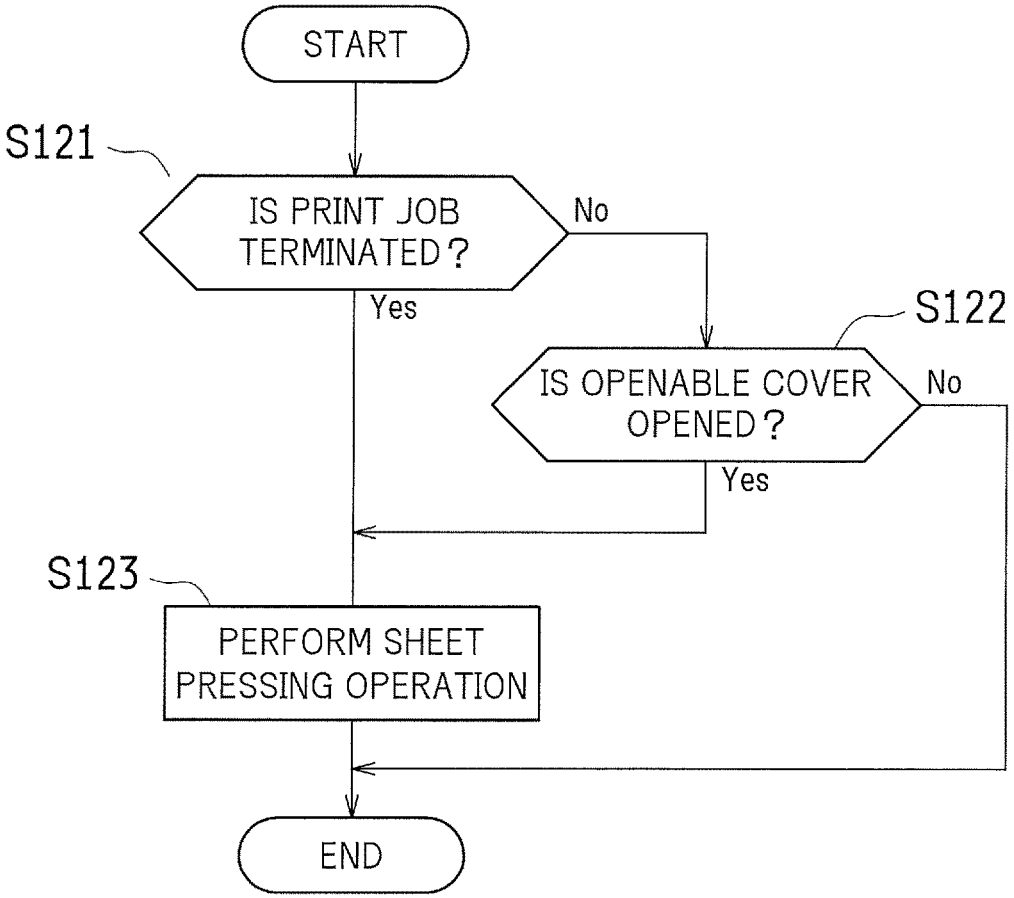
FIG. 18 is a flowchart illustrating a case where the sheet pressing operation is performed based on a first example.

FIG. 18 is a flowchart illustrating a case where the sheet pressing operation is performed based on the first example. In the control illustrated in FIG. 18, when it is determined that the print job is terminated (step S121: Yes) or when it is determined that the openable cover 201 is opened (step S122: Yes), the pressing lever 270 performs the sheet pressing operation (step S123).

Next, a second example is described. Specifically, whether the sheet P is remaining nipped by the feed rollers 211*b* and 211*c* is detected, and the sheet pressing operation may be performed at a timing when the nipping of the sheet P is detected.

In the second example, the sheet pressing operation is performed at at least one of:

(3) a timing at which the detection by a first sheet detection sensor (not illustrated) disposed immediately on the downstream side of the feed rollers 211*b* and 211*c* indicates the presence of the sheet P for a predetermined period of time or longer; and (4) a timing at which the detection by a second sheet detection sensor (not illustrated) disposed before the nip portion between the feed rollers 211*b* and 211*c* indicates the presence of the sheet P for a predetermined period of time or longer.

At the timing (3), the sheet P remaining still while being nipped between the feed rollers 211*b* and 211*c* is detected, and thus the sheet pressing operation is preferably performed. More specifically, the sheet P detected to be present for the predetermined period of time or longer by the first sheet detection sensor, with which the sheets are intermittently detected during the normal sheet conveyance, can be determined as being remaining nipped between the rollers with the conveyance stopped.

Still, with the detection at the timing (3), how much the leading edge of the sheet P being nipped between the feed rollers 211*b* and 211*c* is protruding from the feed rollers 211*b* and 211*c* cannot be determined. The pressing operation might fail to be appropriately performed when the protruding amount of the sheet P is large. Thus, when the sheet pressing operation is performed at the timing (3), the feed rollers 211*b* and 211*c* may be rotated in the reverse direction, and then the sheet pressing operation may be performed after the first sheet detection sensor turns OFF (state of not detecting the sheet).

With the timing (4), the sheet P that has stopped before the nip portion between the feed rollers 211*b* and 211*c* can be pressed back onto the stacking tray 221. Specifically, the sheet P detected to be present for the predetermined period of time or longer by the second sheet detection sensor can also be determined to be in the state in which its conveyance has stopped.

Figure 19:
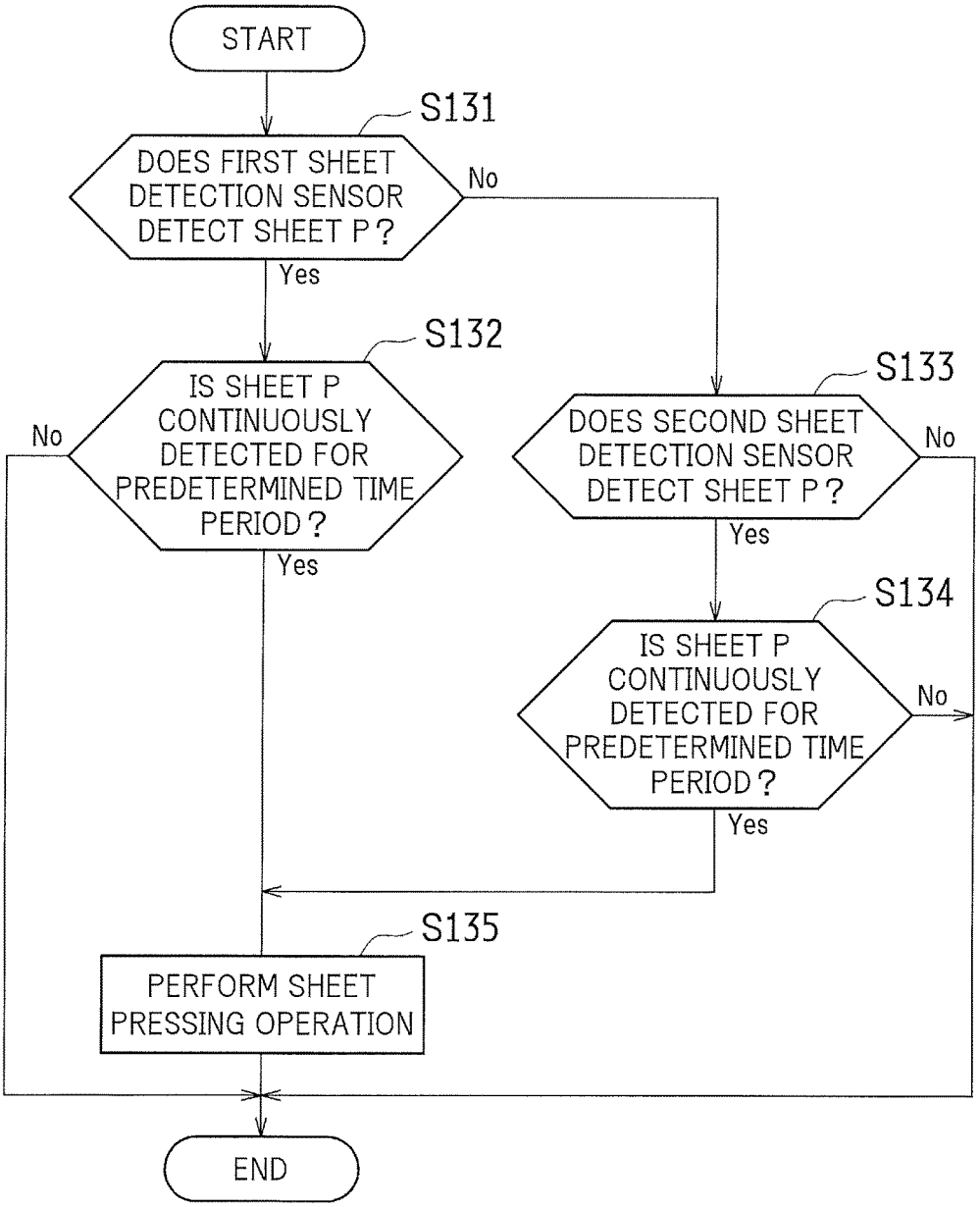
FIG. 19 is a flowchart illustrating a case where the sheet pressing operation is performed based on a second example.

FIG. 19 is a flowchart illustrating a case where the sheet pressing operation is performed based on the second example. In the control illustrated in FIG. 19, when the first sheet detection sensor detects the sheet P (step S131: Yes) and the sheet P is continuously detected for the predetermined time period (step S132: Yes), the pressing lever 270 performs the sheet pressing operation (step S135). Furthermore, when the second sheet detection sensor detects the sheet P (step S133: Yes) and the sheet P is continuously detected for the predetermined time period (step S134: Yes), the pressing lever 270 performs the sheet pressing operation (step S135). When the sheet P is not continuously detected for the predetermined time period in step S132 or S134 (step S132: No or step S134: No), the sheet pressing operation is not performed.

Second Embodiment

In this second embodiment, an example of control performed when the pressing operation is performed for the sheet P is described more in detail.

When the pressing lever 270 performs the operation of pressing the sheet P, the leading edge of the sheet P, pressed back with this operation, needs to be within a movable range of the lever portion 2702 of the pressing lever 270. This means that the sheet P remaining in the state of being nipped between the feed rollers 211*b* and 211*c* might be damaged by bending or the like by the operation of the pressing lever 270, when the leading edge of the sheet P is beyond the movable range of the lever portion 2702.

Thus, in the sheet feed device 200 according to the second embodiment, the leading edge of the sheet P beyond the movable range of the lever portion 2702 is detected. When such a state is detected, the pressing lever 270 does not perform the operation of pressing the sheet P. Instead, the feed rollers 211*b* and 211*c* are driven for conveying the sheet P toward the image forming apparatus main body 110.

In a specific example, a sheet detection sensor is disposed immediately on the downstream side of the movable range of the lever portion 2702, and on the downstream side of the feed rollers 211*b* and 211*c* (between the feed rollers 211*b* and 211*c* and the conveyance roller 211*e* in FIG. 2). When the sheet detection sensor detects a sheet, the pressing lever 270 does not perform the operation of pressing the sheet P. Instead, the feed rollers 211*b* and 211*c* are driven for conveying the sheet P. With this control, the sheet P can be prevented from being damaged by the operation of the pressing lever 270 in an inappropriate situation. The control is performed by the control unit 120.

Third Embodiment

In this third embodiment, another example of the control performed when the pressing operation is performed for the sheet P is described more in detail.

The sheet conveyance might stop in a state where the sheet P is nipped between the feed rollers 211*b* and 211*c* due to the user opening the openable cover 201 of the sheet feed device 200 while the sheet feed operation is in process. Generally, this happens when the image forming apparatus 100 is performing a successive print job on a plurality of sheets, and the sheet waiting to be conveyed is nipped between the feed rollers 211*b* and 211*c* in a standby state. In this state, the rotation of the feed rollers 211*b* and 211*c* for conveying the sheet is stopped. When the preceding sheet advances to a predetermined position so that the sheet in the standby state can be conveyed, the feed rollers 211*b* and 211*c* are rotated for resuming the conveyance of the sheet P.

In the configuration described above, the leading edge of the standby sheet being nipped between the feed rollers 211*b* and 211*c* will never exceed the movable range of the lever portion 2702, as long as the rotation of the feed rollers 211*b* and 211*c* is stopped.

Thus, in the control according to the third embodiment, when the user opens the openable cover 201 of the sheet feed device 200 while the sheet feed operation is in process, the control unit 120 determines whether the feed rollers 211*b* and 211*c* are rotating. The control unit 120 performs control in such a manner that the pressing lever 270 performs the operation of pressing the sheet P when the feed rollers 211*b* and 211*c* are not rotating, and that the pressing lever 270 does not perform the operation of pressing the sheet P and the sheet P is conveyed toward the image forming apparatus main body 110 with the feed rollers 211*b* and 211*c* kept driven when the feed rollers 211*b* and 211*c* are rotating. Whether the feed rollers 211*b* and 211*c* are rotating can be determined based on a driving signal of the feed rollers 211*b* and 211*c*. Also with this control, the sheet P can be prevented from being damaged by the operation of the pressing lever 270 in an inappropriate situation.

The embodiments disclosed herein are given by way of example in any way and do not form a basis for restrictive interpretation. The technical scope of the present invention is therefore not interpreted solely by the embodiments described above, but defined on the basis of the scope of the appended claims. The present invention includes all changes that fall within the scope of the appended claims and the meaning and scope of equivalents of the claims.

What is claimed is:

1. A sheet feed device comprising:

a stacking tray on which sheets are stacked;

a pair of sheet feed rollers configured to convey the sheets from the stacking tray; and a pressing member configured to perform operation at a predetermined timing for pressing back, toward the stacking tray, a sheet that has been picked up from the stacking tray and is in a state of being nipped between the sheet feed rollers with a leading edge of the sheet being on a downstream side of the sheet feed rollers in a conveyance direction.

2. The sheet feed device according to claim 1, wherein the pressing member is configured to perform the operation of pressing back the sheet, at at least one of the following timings: a timing at which a sheet output detection unit of an image forming apparatus detects that the sheet is discharged from the image forming apparatus including the sheet feed device; a timing at which a sheet output detection unit of the sheet feed device detects that the sheet is discharged from the sheet feed device; and a timing at which an openable cover detection unit of the sheet feed device detects opening of an openable cover included in the sheet feed device.

3. The sheet feed device according to claim 1, wherein the pressing member is configured to perform the operation of pressing back the sheet, at at least one of a timing at which a first sheet detection sensor, disposed immediately on a downstream side of the sheet feed roller, detects that the sheet is present for a predetermined time period, and a timing at which a second sheet detection sensor, disposed before a nip portion between the sheet feed rollers, detects that the sheet is present for a predetermined time period.

4. The sheet feed device according to claim 1, wherein the pressing member includes a lever portion capable of pivoting about a fulcrum, and wherein the lever portion is configured to move from a downstream side to an upstream side, over a nip portion between the sheet feed rollers, in a conveyance direction on a conveyance path for the sheet when the pressing member performs the operation of pressing back the sheet.

5. The sheet feed device according to claim 1 further comprising a holding member configured to hold the pressing member, wherein the sheet feed rollers are disposed more on a downstream side in a conveyance direction than the holding member, and wherein the holding member is configured to be detachably attached to a main body of the sheet feed device.

6. The sheet feed device according to claim 5 further comprising a first lever that is provided to the main body of the sheet feed device and is driven by a driving unit, wherein the pressing member is engaged with the first lever, and is configured to receive driving force from the first lever.

7. The sheet feed device according to claim 5, wherein the holding member includes a guide member configured to guide the sheets on the stacking tray to the sheet feed rollers.

8. The sheet feed device according to claim 1 further comprising a roller separating mechanism configured to separate the sheet feed rollers performing the nipping from each other, when the pressing member performs the operation of pressing back the sheet.

9. The sheet feed device according to claim 8, wherein the pressing member and the roller separating mechanism are driven by a same driving unit.

10. The sheet feed device according to claim 8, wherein the pressing member performs the operation of pressing back the sheet after the roller separating mechanism has performed the operation of separating the sheet feed rollers performing the nipping from each other.

11. An image forming apparatus comprising the sheet feed device according to claim 1.

* * * * *